US011261855B2

(12) United States Patent
Jeon et al.

(10) Patent No.: US 11,261,855 B2
(45) Date of Patent: Mar. 1, 2022

(54) LINEAR COMPRESSOR

(71) Applicant: LG Electronics Inc., Seoul (KR)

(72) Inventors: Wooju Jeon, Seoul (KR); Donghan Kim, Seoul (KR); Youngpil Kim, Seoul (KR); Eonpyo Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 37 days.

(21) Appl. No.: 16/678,956

(22) Filed: Nov. 8, 2019

(65) Prior Publication Data

US 2020/0149518 A1 May 14, 2020

(30) Foreign Application Priority Data

Nov. 9, 2018 (KR) ..... 10-2018-0137122

(51) Int. Cl.

| | |
|---|---|
| ***F04B 35/04*** | (2006.01) |
| ***F04B 39/02*** | (2006.01) |
| ***F04B 39/00*** | (2006.01) |
| ***F04B 39/12*** | (2006.01) |

(52) U.S. Cl.

CPC ..... *F04B 35/04* (2013.01); *F04B 39/00* (2013.01); *F04B 39/02* (2013.01); *F04B 39/122* (2013.01); *F04B 35/045* (2013.01); *F04B 2201/0201* (2013.01)

(58) Field of Classification Search

CPC ..... F04B 35/04; F04B 35/045; F04B 2201/0201; F04B 39/16; F04B 39/126; F04B 39/00; F04B 39/0005; F04B 39/122; F04B 39/02; F04B 39/102; F04B 39/1026

See application file for complete search history.

(56) References Cited

U.S. PATENT DOCUMENTS

| | | | | |
|---|---|---|---|---|
| 2,907,304 | A * | 10/1959 | Macks | F15B 15/1428 91/6 |
| 9,599,130 | B2 | 3/2017 | Muhle et al. | |
| 2002/0122732 | A1* | 9/2002 | Oh | F04B 35/045 417/363 |
| 2014/0053720 | A1* | 2/2014 | Ahn | F04B 39/123 91/418 |

(Continued)

FOREIGN PATENT DOCUMENTS

| | | |
|---|---|---|
| CN | 103946545 | 7/2014 |
| CN | 104033353 | 9/2014 |

(Continued)

OTHER PUBLICATIONS

Office Action in Chinese Appln. No. 201911077024.6, dated May 6, 2021, 13 pages (with English translation).

*Primary Examiner* — Essama Omgba
*Assistant Examiner* — Christopher J Brunjes
(74) *Attorney, Agent, or Firm* — Fish & Richardson P.C.

(57) ABSTRACT

Disclosed herein is a linear compressor. The linear compressor includes a piston, a cylinder, a frame, a first bearing gap formed between an inner circumferential surface of the frame and the outer circumferential surface of the cylinder, a second bearing gap formed between an inner circumferential surface of the cylinder and the outer circumferential surface of the piston, a bearing inflow passage and a bearing side passage formed in the cylinder such that fluid flows from the first bearing gap to the second bearing gap.

20 Claims, 22 Drawing Sheets

(56) References Cited

U.S. PATENT DOCUMENTS

| | | | | |
|---|---|---|---|---|
| 2014/0283679 | A1* | 9/2014 | Muhle | F04B 39/122<br>92/143 |
| 2015/0078925 | A1* | 3/2015 | Choi | F04B 53/008<br>417/228 |
| 2015/0369225 | A1* | 12/2015 | Ha | F04B 53/008<br>417/443 |
| 2015/0369238 | A1* | 12/2015 | Park | F04B 39/0005<br>417/437 |
| 2017/0009886 | A1* | 1/2017 | Pegg | F16J 10/04 |
| 2017/0298913 | A1* | 10/2017 | Kim | F04B 9/06 |
| 2017/0314542 | A1* | 11/2017 | Ha | F04B 39/16 |
| 2020/0011316 | A1* | 1/2020 | Jeon | F04B 39/123 |

FOREIGN PATENT DOCUMENTS

| | | |
|---|---|---|
| CN | 104220752 | 12/2014 |
| CN | 105298799 | 2/2016 |
| CN | 107339207 | 11/2017 |
| KR | 1020090048174 | 5/2009 |
| KR | 20140100965 | 8/2014 |
| KR | 20160000403 | 1/2016 |
| KR | 1020160000324 | 1/2016 |

* cited by examiner

LINEAR COMPRESSOR

CROSS-REFERENCE TO RELATED APPLICATIONS

The present application claims priority under 35 U.S.C. 119 and 35 U.S.C. 365 to Korean Patent Application No. 10-2018-0137122 filed on Nov. 9, 2018, which is hereby incorporated by reference in its entirety.

BACKGROUND

The present disclosure relates to a linear compressor.

In general, compressors are machines that receive power from a power generation device such as an electric motor or a turbine to compress air, a refrigerant, or various working gases, thereby increasing a pressure. Compressors are being widely used in home appliances or industrial fields.

Compressors are largely classified into reciprocating compressors, rotary compressors, and scroll compressors.

In such a reciprocating compressor, a compression space, in which a working gas is suctioned or discharged, is provided between a potion and a cylinder so that a refrigerant is compressed while the piston linearly reciprocates within the cylinder.

In addition, in such a rotary compressor, a compression space, in which a working gas is suctioned or discharged, is provided between a roller that rotates eccentrically and a cylinder so that a refrigerant is compressed while the roller rotates eccentrically along an inner wall of the cylinder.

In addition, in such a scroll compressor, a compression space, in which a working gas is suctioned and discharged, is provided between an orbiting scroll and a fixed scroll so that a refrigerant is compressed while the orbiting scroll rotates along the fixed scroll.

In recent years, a linear compressor, in which a piston is directly connected to a driving motor that linearly reciprocates, among the reciprocating compressors has been developed. The linear compressor has a simple structure that is capable of improving compression efficiency without mechanical loss due to motion switching.

In the linear compressor, the piston linearly reciprocates within the cylinder by the driving motor (a linear motor) in a sealed shell. Since the piston linearly reciprocates, the refrigerant is suctioned and compressed and then is discharged.

Also, the linear compressor may supply a refrigerant gas to the piston that linearly reciprocates to perform a bearing function. That is, the linear compressor may be driven through a gas bearing structure using the refrigerant without using a separate bearing fluid such as oil.

In relation to the linear compressor having such a gas bearing structure, the present applicant has field a prior art document 1.

PRIOR ART DOCUMENT 1

1. Korean Patent Publication Number: 10-2016-0000324 (Date of Publication: Jan. 4, 2016)

2. Tile of the Invention: LINEAR COMPRESSOR

A gas bearing structure in which a refrigerant gas is supplied into a space between a cylinder and a piston to perform a bearing function is disclosed in the linear compressor of the prior art document 1. The refrigerant gas flows to an outer circumferential surface of the piston through the cylinder to act as a bearing with respect to the piston.

In detail, a gas inflow part that is recessed inward is provided in an outer circumferential surface of the cylinder to receive a gas refrigerant. Also, an orifice is provided from the gas inflow part to the inner circumferential surface of the cylinder, and the gas refrigerant accommodated in the gas inflow part flows to the outer circumferential surface of the piston through the orifice.

Also, in relation to a linear compressor having such a gas bearing structure, Prior Art Document 2 has also been disclosed.

PRIOR ART DOCUMENT 2

1. Registration number: U.S. Pat. No. 9,599,130

2. Title of Invention: FLOW RESTRICTOR AND GAS COMPRESSOR

The prior art document 2 relates to a compressor having a gas bearing, and supplies gas refrigerant serving as a bearing from an outer circumferential surface to an inner circumferential surface of the cylinder. In this case, the cylinder includes a housing through which refrigerant flows and a flow restrictor installed in the housing.

In this case, the gas bearing structures of the prior art 1 and the prior art 2 have the following problems.

(1) The gas refrigerant flowing to the outer circumferential surface of the piston cannot effectively support the piston. Specifically, a supporting force for supporting the piston is generated only at a portion where the refrigerant is supplied from the cylinder. Therefore, there is a problem that a relatively large numbers of structures in which refrigerant passes through the cylinder need to be formed in order to more stably support the piston.

(2) Further, when the relatively large numbers of the structures in which the refrigerant passes through the cylinder are formed, a relatively large amount of gas refrigerant needs to be supplied. As described above, when a relatively large amount of gas refrigerant is supplied as the gas bearing, there is a problem that the flow rate of the refrigerant in an entire system is reduced and the compression efficiency is reduced.

(3) In the prior art 1, there is a problem that the orifice is closed by foreign substances contained in the gas refrigerant contained in a gas inflow portion. Accordingly, the gas refrigerant cannot flow through the orifice, and as a result, the driving part such as the piston may be damaged.

(4) Furthermore, the structure disclosed in the prior art 2 is very complicated, so that it is actually difficult to implement.

SUMMARY

The present invention has been made to solve the above-mentioned problems occurring in the prior art and an object of the present invention is to provide a linear compressor which effectively supports a piston with a relatively small amount of gas refrigerant.

Specifically, the object of the present invention is to provide a linear compressor which entirely supports the piston in the circumferential direction through bearing inflow passages and a bearing side passage connecting the bearing inflow passages in the circumferential direction.

Another object of the present invention is to provide a linear compressor in which the refrigerant flow rate of the entire system is increased and the compression efficiency is improved by using a relatively small amount of gas refrigerant as a gas bearing.

A linear compressor according to an aspect of the present invention includes a piston configured to reciprocate in an axial direction, a cylinder disposed outside the piston in a radial direction to surround an outer circumferential surface of a piston, and a frame disposed outside the cylinder in the radial direction to surround an outer circumferential surface of the cylinder.

Further, the linear compressor may be provided with a first bearing gap formed between an inner circumferential surface of the frame and the outer circumferential surface of the cylinder, and a second bearing gap formed between an inner circumferential surface of the cylinder and the outer circumferential surface of the piston.

In addition, the linear compressor may be further provided with a bearing inflow passage formed in the cylinder such that fluid flows from the first bearing gap to the second bearing gap.

The linear compressor may include a bearing side passage formed to be recessed in the inner circumferential surface of the cylinder in a circumferential direction.

In particular, the bearing side passage may be formed such that fluid flowing through the bearing inflow passage flows in the circumferential direction.

Therefore, the fluid may be disposed to surround the outer circumferential surface of the piston to more effectively support the piston.

Also, a plurality of bearing inflow passages are formed to be spaced apart from one another in the circumferential direction and the bearing side passage may be formed to connect the plurality of bearing inflow passages spaced apart from one another in the circumferential direction.

DETAILED DESCRIPTION OF THE EMBODIMENTS

Figure 1:
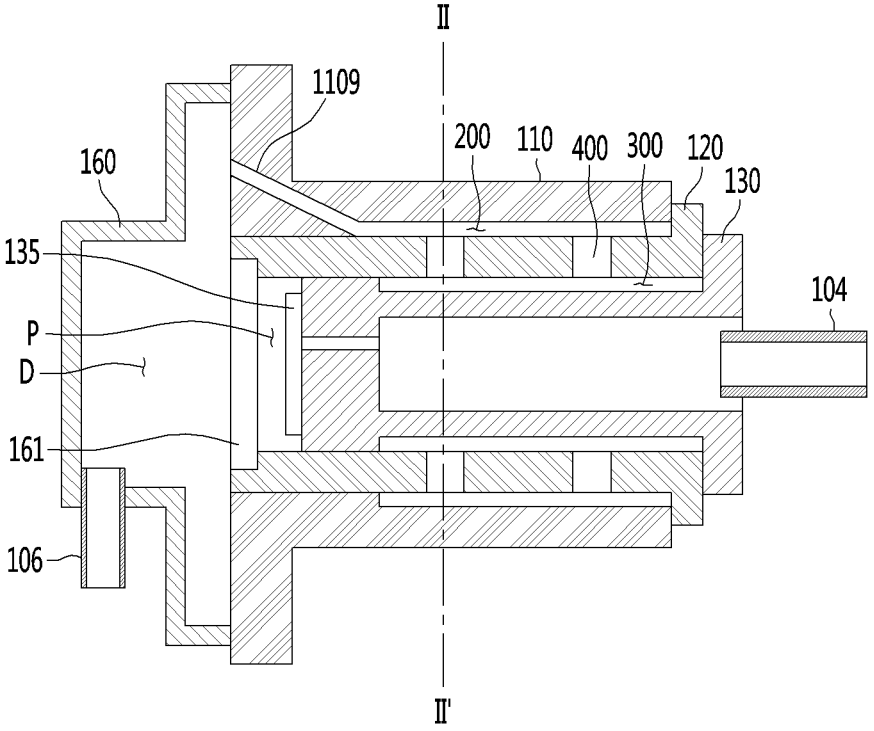
FIG. 1 is a view schematically showing a configuration of a linear compressor according to an embodiment of the present invention.

Hereinafter, embodiments of the present invention will be described in detail with reference to the accompanying drawings. It is noted that the same or similar components in the drawings are designated by the same reference numerals as far as possible even if they are shown in different drawings. In the following description of the present disclosure, a detailed description of known functions and configurations incorporated herein will be omitted to avoid making the subject matter of the present disclosure unclear.

In the description of the elements of the present disclosure, the terms 'first', 'second', 'A', 'B', '(a)', and '(b)' may be used. However, since the terms are used only to distinguish an element from another, the essence, sequence, and order of the elements are not limited by them. When it is described that an element is "coupled to", "engaged with", or "connected to" another element, it should be understood that the element may be directly coupled or connected to the other element but still another element may be "coupled to", "engaged with", or "connected to" the other element between them.

FIG. 1 is a diagram schematically showing a configuration of a linear compressor according to an embodiment of the present invention.

As shown in FIG. 1, a linear compressor 10 according to an embodiment of the present invention includes a piston 130, a cylinder 120, and a frame 110.

The piston 130 corresponds to a reciprocating configuration. In particular, the piston 130 linearly reciprocates in one direction and compresses a refrigerant. In this case, the one direction is referred to as an axial direction, and the axial direction corresponds to a horizontal direction in FIG. 1.

The cylinder 120 corresponds to a configuration that accommodates the piston 130. Specifically, the cylinder 120 is disposed outside the piston 130 in a radial direction to surround an outer circumferential surface of the piston 130.

The radial direction corresponds to a direction perpendicular to the axial direction. In FIG. 1, a vertical direction may be understood as one of radial directions. Of the radial directions, a direction from the piston 130 toward the cylinder 120 is referred to as a radially outer side, and the opposite direction is referred to as a radially inner side.

In addition, the cylinder 120 corresponds to a configuration that forms a compression space P in which refrigerant is compressed by the piston 130. The compression space P corresponds to a space formed in front of the piston 130 in the axial direction and inside the cylinder 120. In addition, the piston 130 is moved frontward in the axial direction to compress the refrigerant received in the compression space P.

Further, the compression space P may be defined as a space formed between the suction valve 135 and the discharge valve 161. In this case, the suction valve 135 and the discharge valve 161 correspond to configurations for controlling the flow of the refrigerant.

The frame 110 corresponds to a configuration for accommodating the cylinder 120. Specifically, the frame 110 is disposed outside the cylinder 120 in the radial direction to surround the outer circumferential surface of the cylinder 120.

The linear compressor (10) includes a suction pipe (104) and a discharge pipe (106). The suction pipe 104 may be understood as a refrigerant pipe through which the refrigerant flows into the linear compressor 10. In addition, the discharge pipe 106 may be understood as a refrigerant pipe through which the refrigerant is discharged from the linear compressor 10.

The suction pipe 104 is disposed axially rearward of the piston 130 to supply the refrigerant to the compression space P. That is, the suction pipe 104 is disposed axially rearward of the piston 130, and the compression space P is formed axially frontward of the piston 130. Therefore, it may be understood that a direction in which the refrigerant flows is axially frontward.

In this case, the axial direction may be understood as a reciprocating motion direction of the piston 130. Of the axial directions, a direction from the suction pipe 104 toward the compression space P is referred to as an axially frontward, and a direction opposite thereto is referred to as an axially rearward. Therefore, when the piston 130 moves in the axial direction, the refrigerant received in the compression space P may be compressed.

The suction pipe 104 may be provided to extend in the reciprocating motion direction of the piston 130. That is, the suction pipe 104 is provided axially rearward of the piston 130 in the axial direction. Accordingly, the refrigerant sucked into the suction pipe 104 may flow into the compression space P with the minimum flow loss to be compressed.

In addition, the linear compressor 10 is provided with a discharge space D through which the refrigerant discharged from the compression space (P) flows. The discharge space D is formed axially frontward of the cylinder 120 and the frame 110.

In addition, the linear compressor 10 includes a discharge cover 160 that forms the discharge space D. The discharge cover 160 may be coupled to the front of the frame 110 to form the discharge space D. The discharge pipe 106 is disposed at one side of the discharge cover 160 to allow the refrigerant received in the discharge space D to flow.

In this case, a predetermined gap exists between the piston 130, the cylinder 120, and the frame 110. The gap means a small gap enough to allow a predetermined fluid to flow.

Specifically, the linear compressor 10 is provided with a first bearing gap 200 formed between the inner circumferential surface of the frame 110 and the outer circumferential surface of the cylinder 120 and a second bearing gap 300 formed between the inner circumferential surface of the cylinder 120 and the outer circumferential surface of the piston 130.

In in FIG. 1 and FIGS. 2A and 2B to be described below, for convenience for description, the first bearing gap 200 and the second bearing gap 300 are shown as being relatively wide. The frame 110, the cylinder 120, and the piston 130 are provided so as to be in contact with each other macroscopically. Accordingly, the first bearing gap 200 and the second bearing gap 300 may not be shown in the drawings (FIGS. 6 and 7), which are shown similarly to the actual dimensions thereof.

The linear compressor 10 includes a bearing inflow passage 400 through which fluid flows from the first bearing gap 200 to the second bearing gap 300. In other words, the bearing inflow passage 400 may be understood as a passage formed to extend from the outer circumferential surface of the cylinder 120 to the inner circumferential surface of the cylinder 120.

In addition, the linear compressor 10 includes a bearing supply passage 1109 for allowing fluid to flow to the first bearing gap 200. The bearing supply passage 1109 is formed to pass through the frame 110. Particularly, the bearing supply passage 1109 is formed such that at least a part of the refrigerant discharged into the discharge space D flows into the first bearing gap 200.

Therefore, the refrigerant flowing into the first bearing gap 200 corresponds to a part of the refrigerant flowing into the discharge space D. The refrigerant flowing into the first bearing gap 200 flows into the second bearing gap 200 through the bearing inflow passage 400.

That is, a part of refrigerant compressed by the piston 130 is supplied to the outer circumferential surface of the piston 130. The refrigerant may function as a bearing to support the piston 130. Hereinafter, this is referred to as bearing refrigerant, and a supporting force of the piston 130 by the bearing refrigerant will be described.

Figure 2A:
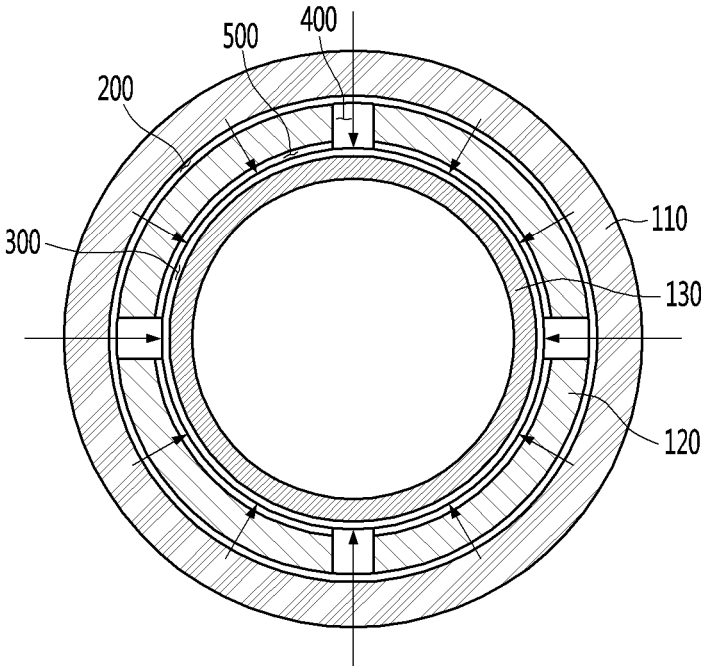
FIGS. 2A and 2B are cross-sectional views taken along line II-II' of FIG. 1.
Figure 2B:
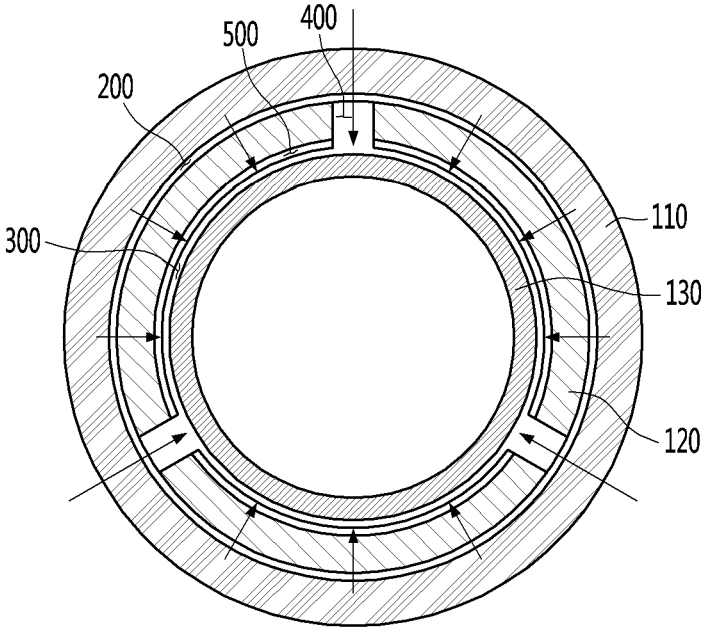

FIGS. 2A and 2B are cross-sectional views taken along line II-II' of FIG. 1.

As shown in FIGS. 2A and 2B, the piston 130, the cylinder 120, and the frame 110 are arranged in order in the radial direction. The first bearing gap 200 is formed between the frame 110 and the cylinder 120 and the second bearing gap 300 is formed between the cylinder 120 and the piston 130.

In addition, the bearing inflow passage 400 is formed in the cylinder 120. A plurality of bearing inflow passages 400 are formed to be spaced apart from one another in the circumferential direction. For example, FIG. 2A shows four bearing inflow passages 400 spaced apart from one another at a spacing of 90 degrees in the circumferential direction. In FIG. 2B, there are shown three bearing inflow passages 400 spaced apart from one another at a spacing of 120 degrees in the circumferential direction.

In this case, the plurality of bearing inflow passages 400 form different passages. In detail, each bearing inflow passage 400 is formed to extend from a bearing inlet end formed on the outer circumferential surface of the cylinder 120 to a bearing outlet end formed on the inner circumferential surface of the cylinder 120. The bearing inlet ends of the plurality of bearing inflow passages 400 are circumferentially spaced apart from one another in the outer circumferential surface of the cylinder 120. The bearing outlet ends of the plurality of bearing inflow passages 400 are circumferentially spaced apart from one another in the inner circumferential surface of the cylinder 120.

Accordingly, the bearing refrigerant flowing from the first bearing gap 200 to the second bearing gap 300 is divided and flows into a plurality of passages. For example, in the case of FIG. 2A, the bearing refrigerant is divided and flows into four passages, and in FIG. 2B, the bearing refrigerant is divided and flows into three passages.

The bearing refrigerant flowing as described supports the piston 130. In detail, the plurality of bearing inflow passages 400 function as pockets in which the bearing refrigerant is received. As described above, the bearing refrigerant corresponds to refrigerant gas compressed by the piston 130 and having a high pressure.

Accordingly, in the bearing inflow passage 400 in which the bearing refrigerant is received, pressure is generated by the pressurized gas to support the piston 130. As the number of the bearing inflow passages 400 increases, the piston 130 may be more stably supported.

This is because supporting force is hardly generated in a surface where the bearing inflow passage 400 is not formed, that is, the second bearing gap 300. The second bearing gap 300 is provided to be very narrow so that a very small amount of fluid flows and its flow rate is very large. Accordingly, the pressure generated in the second bearing gap 300 is very small, so that the piston 130 is hardly supported.

However, as the number of bearing inflow passages 400 increases, the amount of bearing refrigerant received in the bearing inflow passages 400 increases. This means that a relatively large amount of refrigerant of refrigerant compressed by the piston 130 is circulated and does not function That is, it is effective that the amount of the bearing refrigerant is minimized in terms of the overall system.

As a result, there is a need to minimize the amount of bearing refrigerant and effectively support the piston. Accordingly, the linear compressor 10 according to the present invention further includes a bearing side passage 500.

The bearing side passage 500 is formed such that the fluid flowing through the bearing inflow passage 400 flows in the circumferential direction. In detail, the bearing side passage 500 is formed to be recessed in the inner circumferential surface of the cylinder 120 along the circumferential direction.

In particular, the bearing side passage 500 is formed with a ring-shaped groove in the inner circumferential surface of the cylinder 120. The bearing side passage 500 is formed on the outer side of the piston 130 so as to be perpendicular to the reciprocating motion direction of the piston 130. Therefore, the bearing side passage 500 is formed with a ring-shaped groove extending in the circumferential direction perpendicular to the axial direction.

In addition, the bearing side passage 500 is formed with a fine-sized groove such that a minute amount of fluid of the fluid flowing into the bearing inflow passage 400 flows. Therefore, the bearing side passage 500 may receive a smaller amount of refrigerant than the bearing inflow passage 400.

Also, the bearing side passage 500 is formed to connect the plurality of bearing inflow passages 400 spaced apart from one another in the circumferential direction. In particular, the bearing side passage 500 is formed to extend in the circumferential direction from the bearing outlet ends of the plurality of bearing inflow passages 400.

Accordingly, the fluid that is divided and flows into the different passages through the bearing inlet ends of the plurality of bearing inflow passages 400 joins together at the bearing outlet ends of the plurality of bearing inflow passages 400 by the bearing side passage 500. In other words, the plurality of bearing inflow passages 400 are formed to extend from the bearing side passage 500 to the outer circumferential surface of the cylinder 120 so as to form different passages.

Due to this structure, the piston 130 can be supported not only by the bearing inflow passages 400 but also by the fluid received in the bearing side passage 500.

Referring to FIG. 2A, four spots of the outer circumferential surface of the piston 130 are supported by the refrigerant received in the bearing side passage 500. The remaining portion is supported by the refrigerant received in the bearing side passage 500.

As a result, the outer circumferential surface of the piston 130 may be entirely supported in the circumferential direction. Therefore, even when the number of the bearing inflow passages 400 is reduced as shown in FIG. 2B, the piston 130 may be effectively supported.

With the flow of the bearing refrigerant, a part of the refrigerant flowing from the compression space P to the discharge space D corresponds to the bearing refrigerant, and flows into the bearing supply passage 1109. The refrigerant flowing into the first bearing gap 200 flows into the second bearing gap 300 through the bearing inflow passage 400.

In this case, the bearing refrigerant flows through the plurality of bearing inflow passages 400, and is received in the bearing inflow passages 400 to generate a pressure for supporting the piston 130. A part of the bearing refrigerant received in each of the bearing inflow passages 400 communicates with one another through the bearing side passage 500. A pressure for supporting the piston 130 is generated by the refrigerant received in the bearing side passage 500.

Referring to FIG. 1, the bearing inflow passage 400 and the bearing side passage 500 are formed between the suction pipe 104 and the compression space P in the axial direction. In other words, the bearing inflow passage 400 and the bearing side passage 500 are formed to be disposed outside the piston 130 even when the piston 130 reciprocates. This is because the bearing inflow passage 400 and the bearing side passage 500 correspond to a structure for supporting the outer circumferential surface of the piston 130.

Also, a plurality of bearing inflow passages 400 and a plurality of bearing side passages 500 may be formed to be spaced apart from each other in the reciprocating motion direction of the piston 130. That is, a plurality of bearing inflow passages 400 and a plurality of bearing side passages 500 are spaced apart from each other in the axial direction. The reason for this is to support the piston 130 more stably.

Hereinafter, specific structures and above-described features of the linear compressor 10 according to the present invention will be described in detail. However, this is an example, and the structure and configuration of the linear compressor 10 are not limited thereto.

Figure 3:
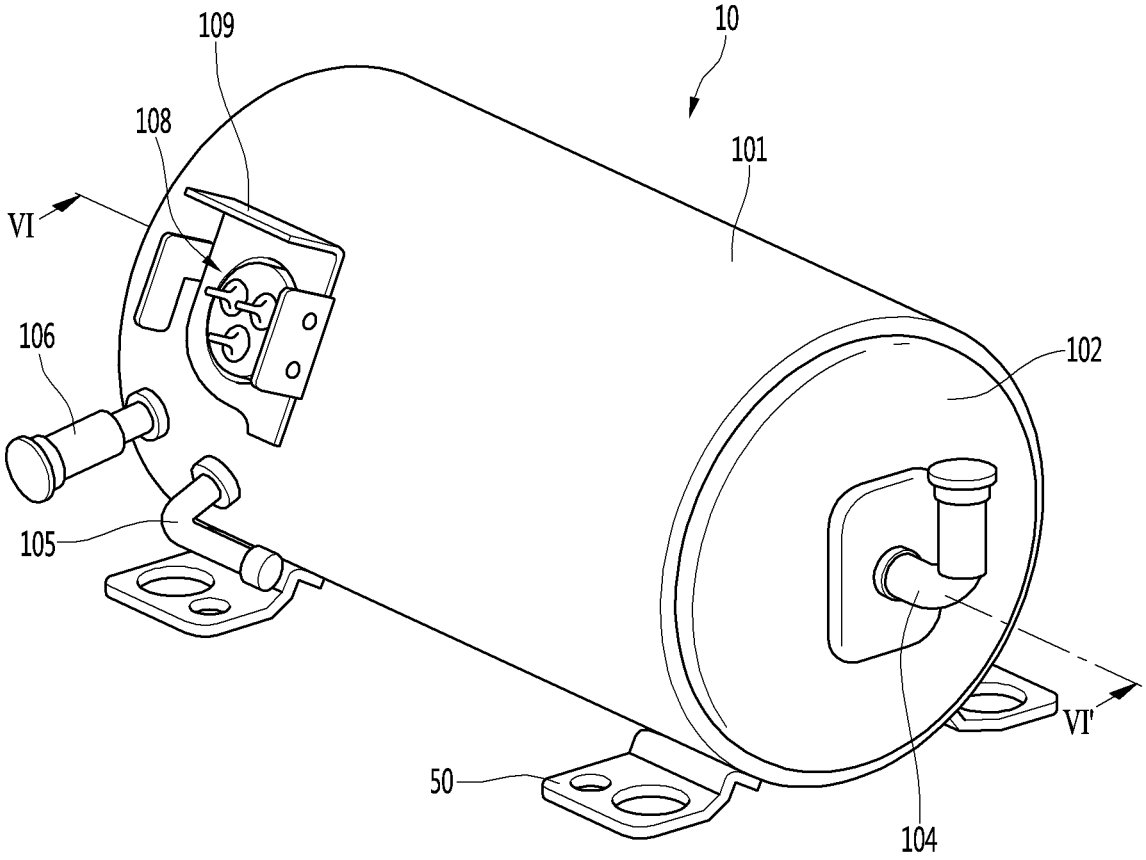
FIG. 3 is a diagram showing a linear compressor according to an embodiment of the present invention.
Figure 4:
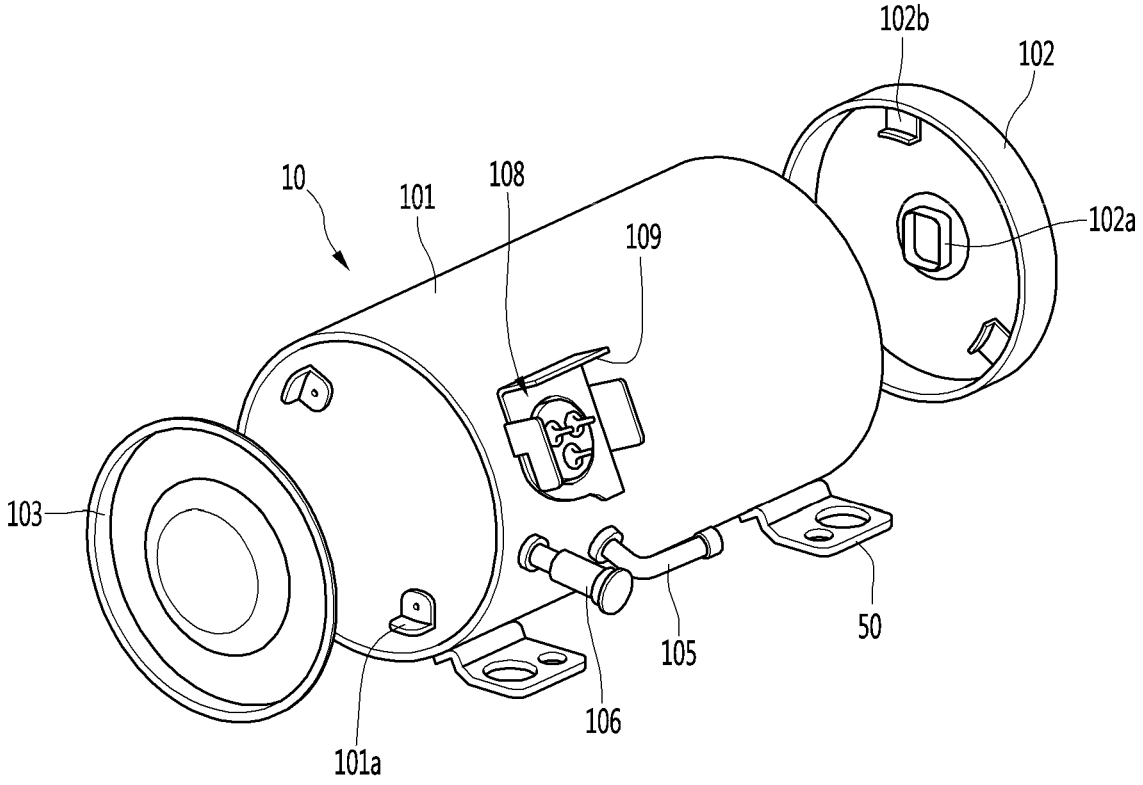
FIG. 4 is an exploded view of a shell and a shell cover of a linear compressor according to an embodiment of the present invention.

FIG. 3 is a view of a linear compressor according to an embodiment, and FIG. 4 is an exploded view illustrating a shell and a shell cover of the linear compressor according to an embodiment.

Referring to FIGS. 3 and 4, a linear compressor 10 according to an embodiment includes a shell 101 and shell covers 102 and 103 coupled to the shell 101. In a broad sense, each of the shell covers 102 and 103 may be understood as one component of the shell 101.

A leg 50 may be coupled to a lower portion of the shell 101. The leg 50 may be coupled to a base of a product in which the linear compressor 10 is installed. For example, the product may include a refrigerator, and the base may include a machine room base of the refrigerator. For another example, the product may include an outdoor unit of an air conditioner, and the base may include a base of the outdoor unit The shell 101 may have an approximately cylindrical shape and be disposed to lie in a horizontal direction or an axial direction. In FIG. 3, the shell 101 may extend in the horizontal direction and have a relatively low height in a radial direction. That is, since the linear compressor 10 has a low height, when the linear compressor 10 is installed in the machine room base of the refrigerator, a machine room may be reduced in height.

A terminal 108 may be installed on an outer surface of the shell 101. The terminal 108 may be understood as a component for transferring external power to a motor assembly (see reference numeral 140 of FIG. 5) of the linear compressor 10. The terminal 108 may be connected to a lead line of a coil (see reference numeral 141*c* of FIG. 5).

A bracket 109 is installed outside the terminal 108. The bracket 109 may include a plurality of brackets surrounding the terminal 108. The bracket 109 may protect the terminal 108 against an external impact and the like.

Both sides of the shell 101 may be opened. The shell covers 102 and 103 may be coupled to both opened sides of the shell 101. In detail, the shell covers 102 and 103 include a first shell cover 102 coupled to one opened side of the shell 101 and a second shell cover 103 coupled to the other opened side of the shell 101. An inner space of the shell 101 may be sealed by the shell covers 102 and 103.

In FIG. 3, the first shell cover 102 may be disposed at a right portion of the linear compressor 10, and the second shell cover 103 may be disposed at a left portion of the linear compressor 10. That is, the first and second shell covers 102 and 103 may be disposed to face each other.

The linear compressor 10 further includes a plurality of pipes 104, 105, and 106, which are provided in the shell 101 or the shell covers 102 and 103 to suction, discharge, or inject the refrigerant. The plurality of pipes 104, 105, and 106 include a suction pipe 104, a discharge pipe 105, and a process pipe 106.

The suction pipe 104 is provided so that the refrigerant is suctioned into the linear compressor 10. For example, the suction pipe 104 may be coupled to the first shell cover 102. The refrigerant may be suctioned into the linear compressor 10 through the suction pipe 104 in an axial direction.

The discharge pipe 105 is provided so that the compressed refrigerant is discharged from the linear compressor 10. The discharge pipe 105 may be coupled to an outer circumferential surface of the shell 101. The refrigerant suctioned through the suction pipe 104 may flow in the axial direction and then be compressed. Also, the compressed refrigerant may be discharged through the discharge pipe 105. The discharge pipe 105 may be disposed at a position that is closer to the second shell cover 103 than the first shell cover 102.

The process pipe 106 may be provided to supplement the refrigerant into the linear compressor 10. The process pipe 106 may be coupled to an outer circumferential surface of the shell 101. A worker may inject the refrigerant into the linear compressor 10 through the process pipe 106.

Here, the process pipe 106 may be coupled to the shell 101 at a height different from that of the discharge pipe 105 to avoid interference with the discharge pipe 105. The height is understood as a distance from the leg 50 in the vertical direction (or the radial direction). Since the discharge pipe 105 and the process pipe 106 are coupled to the outer circumferential surface of the shell 101 at the heights different from each other, worker's work convenience may be improved.

At least a portion of the second shell cover 103 may be disposed adjacent to the inner circumferential surface of the shell 101, which corresponds to a point to which the process pipe 106 is coupled. That is, at least a portion of the second shell cover 103 may act as flow resistance of the refrigerant injected through the process pipe 106.

Thus, in view of the passage of the refrigerant, the passage of the refrigerant introduced through the process pipe 106 may have a size that gradually decreases toward the inner space of the shell 101. In this process, the refrigerant may decrease in pressure to evaporate the refrigerant.

Also, in this process, an oil component contained in the refrigerant may be separated. Thus, the gas refrigerant from which the oil component is separated may be introduced into the piston 130 to improve compression performance of the refrigerant. Here, the oil component may be understood as working oil existing in a cooling system.

A cover support part 102*a* is disposed on an inner surface of the first shell cover 102. A second support device 185 that will be described later may be coupled to the cover support part 102*a*. The cover support part 102*a* and the second support device 185 may be understood as devices for supporting a main body of the linear compressor 10. Here, the main body of the compressor represents a component provided in the shell 101. For example, the main body may include a driving part that reciprocates forward and backward and a support part supporting the driving part.

The driving part may include components such as the piston 130, a magnet frame 138, a permanent magnet 146, a support 137, and a suction muffler 150, which will be described later. Also, the support part may include components such as resonant springs 176*a* and 176*b*, a rear cover 170, a stator cover 149, a first support device 165, and a second support device 185, which will be described later.

A stopper 102*b* may be disposed on the inner surface of the first shell cover 102. The stopper 102*b* may be understood as a component for preventing the main body of the compressor, particularly, the motor assembly 140 from being bumped by the shell 101 and thus damaged due to the vibration or the impact occurring during the transportation of the linear compressor 10.

Particularly, the stopper 102*b* may be disposed adjacent to the rear cover 170 that will be described later. Thus, when the linear compressor 10 is shaken, the rear cover 170 may interfere with the stopper 102*b* to prevent the impact from being transmitted to the motor assembly 140.

A spring coupling part 101*a* may be disposed on the inner circumferential surface of the shell 101. For example, the spring coupling part 101*a* may be disposed at a position that is adjacent to the second shell cover 103. The spring coupling part 101*a* may be coupled to a first support spring 166 of the first support device 165 that will be described later. Since the spring coupling part 101*a* and the first support device 165 are coupled to each other, the main body of the compressor may be stably supported inside the shell 101.

Figure 5:
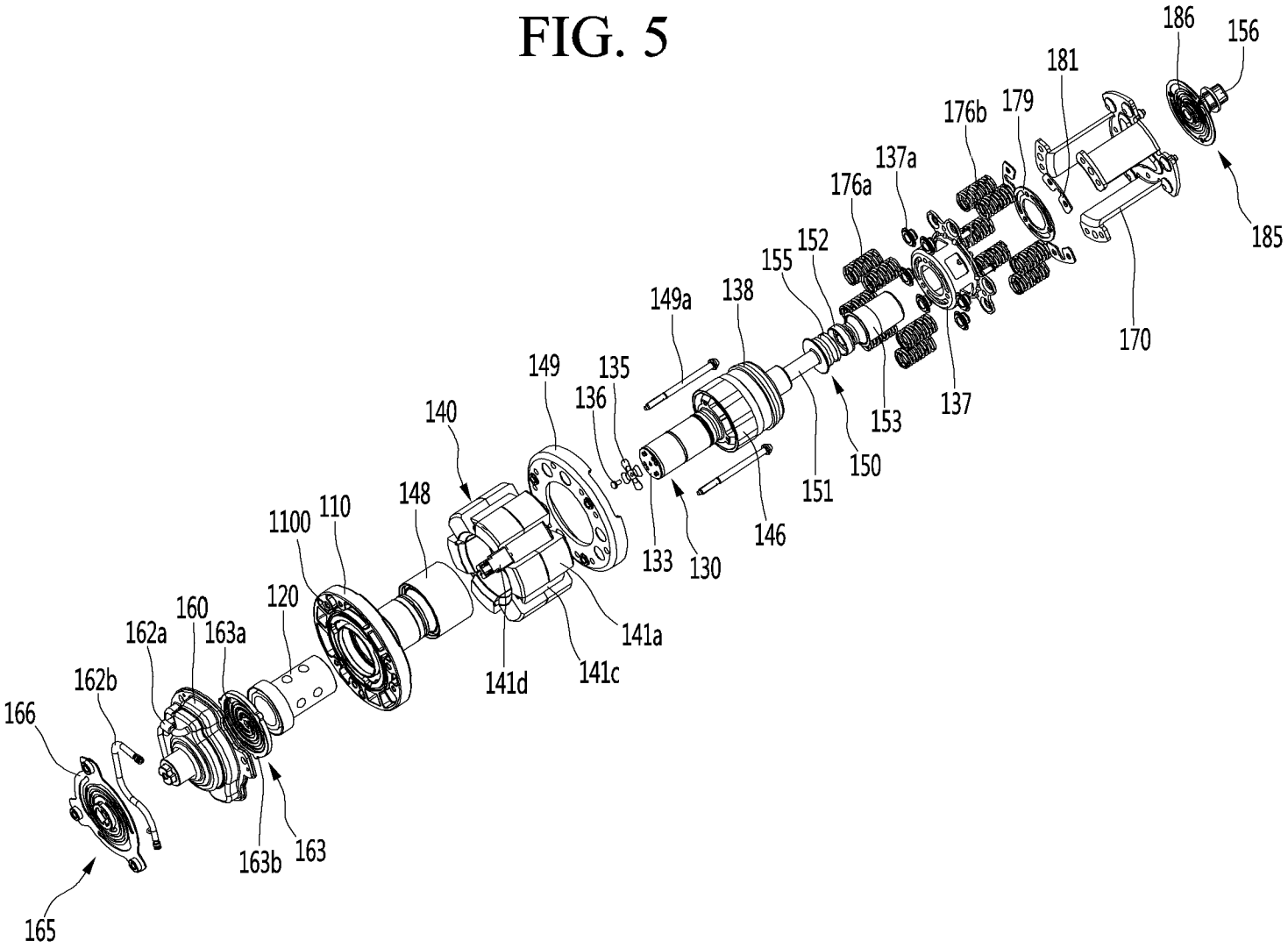
FIG. 5 is an exploded view of an internal configuration of a linear compressor according to an embodiment of the present invention.
Figure 6:
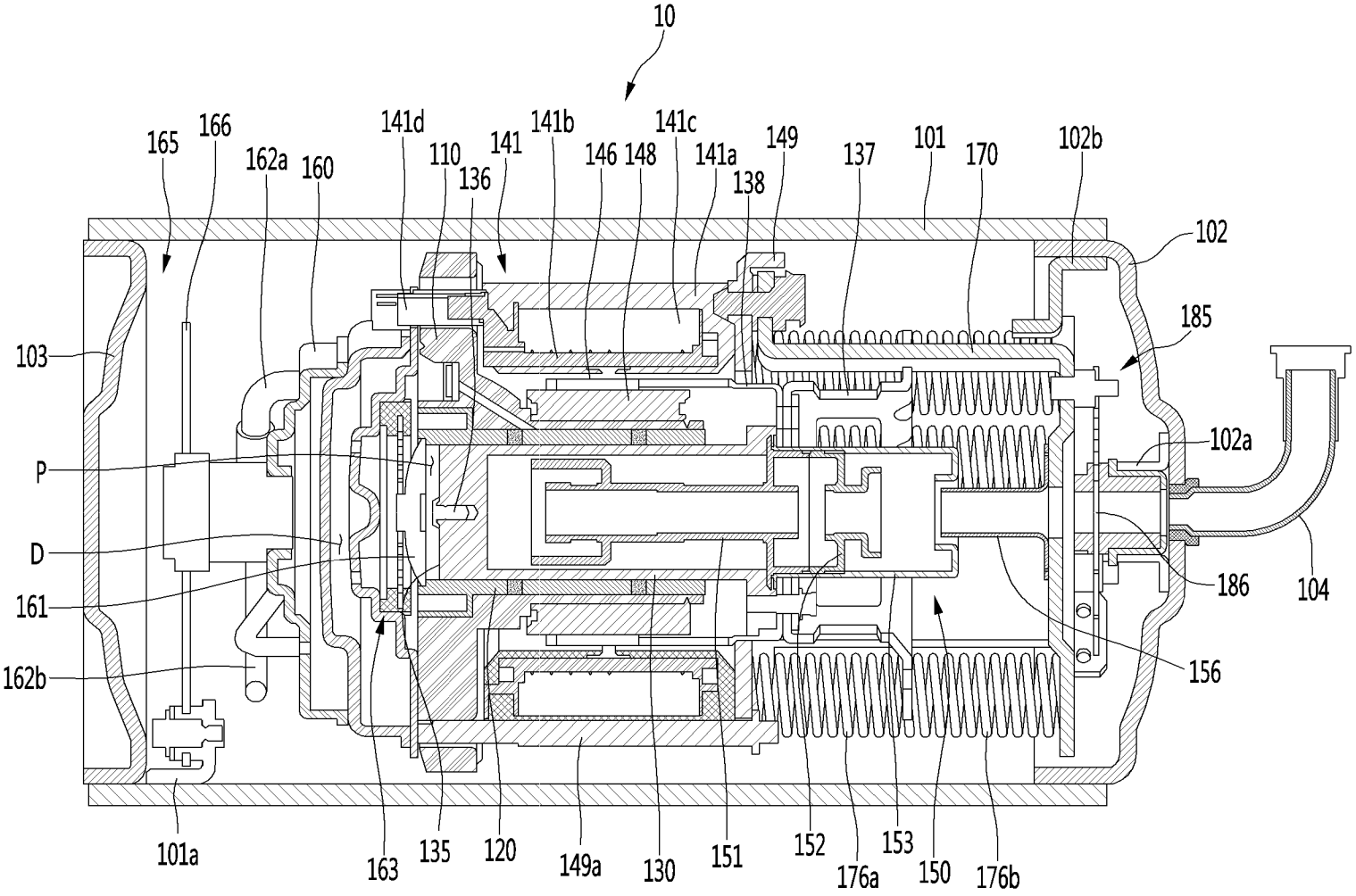
FIG. 6 is a cross-sectional view taken along line VI-VI' of FIG. 3.

FIG. 5 is an exploded view of an internal configuration of a linear compressor according to an embodiment of the present invention, and FIG. 6 is a cross-sectional view taken along line VI-VI' of FIG. 3. FIG. 5, the shell 101, the shell 101 and the shell covers 102 and 103, and the like are omitted for convenience of description.

As shown in FIGS. 5 and 6, a linear compressor 10 according to the present invention includes a frame 110, a cylinder 120, a piston 130 and a motor assembly 140. The motor assembly 140 corresponds to a linear motor that provides a driving force to the piston 130. The piston 130 may reciprocate according to driving of the motor assembly 140.

The cylinder 120 is accommodated in the frame 110. Here, the frame 110 is understood as a component for fixing the cylinder 120. For example, the cylinder 120 may be press-fitted into the frame 110.

Also, the piston 130 is movably accommodated in the cylinder 120. Also, the linear compressor 10 further includes a suction muffler 150 accommodated in the piston 130.

The suction muffler 150 may correspond to a component for reducing noise generated from the refrigerant suctioned through the suction pipe 104. In detail, the refrigerant suctioned through the suction pipe 104 flows into the piston 130 via the suction muffler 150. While the refrigerant passes through the suction muffler 150, the flow noise of the refrigerant may be reduced.

The suction muffler 150 includes a plurality of mufflers 151, 152, and 153. The plurality of mufflers 151, 152, and 153 include a first muffler 151, a second muffler 152, and a third muffler 153, which are coupled to each other. The refrigerant suctioned through the suction pipe 104 may successively pass through the third muffler 153, the second muffler 152, and the first muffler 151.

In detail, the first muffler 151 is disposed within the piston 130, and the second muffler 152 is coupled to a rear side of the first muffler 151. Also, the third muffler 153 accommodates the second muffler 152 therein and extends to a rear side of the first muffler 151.

Also, the suction muffler 150 further includes a muffler filter 155. The muffler filter 155 may be disposed on an interface on which the first muffler 151 and the second muffler 152 are coupled to each other. For example, the muffler filter 155 may have a circular shape, and an outer circumferential portion of the muffler filter 155 may be supported between the first and second mufflers 151 and 152.

The cylinder 120 has a compression space P in which the refrigerant is compressed by the piston 130. Also, a suction hole 133 through which the refrigerant is introduced into the compression space P is defined in a front surface of the piston 130, and a suction valve 135 for selectively opening the suction hole 133 is disposed on a front side of the suction hole 133. The suction valve 135 may be coupled to the piston 130 by a coupling member 136.

A discharge cover 160 defining a discharge space D for the refrigerant discharged from the compression space P and a discharge valve assembly 161 and 163 coupled to the discharge cover 160 to selectively discharge the refrigerant compressed in the compression space P are provided at a front side of the compression space P. The discharge space D includes a plurality of space parts that are partitioned by inner walls of the discharge cover 160. The plurality of space parts are disposed in the front and rear direction to communicate with each other.

The discharge valve assembly 161 and 163 includes a discharge valve 161 that is opened when the pressure of the compression space P is above a discharge pressure to introduce the refrigerant into the discharge space and a spring assembly 163 disposed between the discharge valve 161 and the discharge cover 160 to provide elastic force in the axial direction.

The spring assembly 163 includes a valve spring 163*a* and a spring support part 163*b* for supporting the valve spring 163*a* to the discharge cover 160. For example, the valve spring 163*a* may include a plate spring. Also, the spring support part 163*b* may be integrally injection-molded to the valve spring 163*a* through an injection-molding process.

The discharge valve 161 is coupled to the valve spring 163*a*, and a rear portion or a rear surface of the discharge valve 161 is disposed to be supported on the front surface of the cylinder 120. When the discharge valve 161 is supported on the front surface of the cylinder 120, the compression space may be maintained in the sealed state. When the discharge valve 161 is spaced apart from the front surface of the cylinder 120, the compression space P may be opened to allow the refrigerant in the compression space P to be discharged.

Thus, the compression space P may be understood as a space defined between the suction valve 135 and the discharge valve 161. Also, the suction valve 135 may be disposed on one side of the compression space P, and the discharge valve 161 may be disposed on the other side of the compression space P, i.e., an opposite side of the suction valve 135.

While the piston 130 linearly reciprocates within the cylinder 120, when the pressure of the compression space P is below the discharge pressure and a suction pressure, the suction valve 135 may be opened to suction the refrigerant into the compression space P. On the other hand, when the pressure of the compression space P is above the suction pressure, the suction valve 135 may compress the refrigerant of the compression space P in a state in which the suction valve 135 is closed.

When the pressure of the compression space P is above the discharge pressure, the valve spring 163*a* may be deformed forward to open the discharge valve 161. Here, the refrigerant may be discharged from the compression space P into the discharge space of the discharge cover 160. When the discharge of the refrigerant is completed, the valve spring 163*a* may provide restoring force to the discharge valve 161 to close the discharge valve 161.

The linear compressor 10 further includes a cover pipe 162*a* coupled to the discharge cover 160 to discharge the refrigerant flowing through the discharge space D of the discharge cover 160. For example, the cover pipe 162*a* may be made of a metal material.

Also, the linear compressor 10 further includes a loop pipe 162*b* coupled to the cover pipe 162*a* to transfer the refrigerant flowing through the cover pipe 162*a* to the discharge pipe 105. The loop pipe 162*b* may have one side of the loop pipe 162*b* coupled to the cover pipe 162*a* and the other side coupled to the discharge pipe 105.

The loop pipe 162*b* may be made of a flexible material and have a relatively long length. Also, the loop pipe 162*b* may roundly extend from the cover pipe 162*a* along the inner circumferential surface of the shell 101 and be coupled to the discharge pipe 105. For example, the loop pipe 162*b* may have a wound shape.

The motor assembly 140 includes an outer stator 141 fixed to the frame 110 and disposed to surround the cylinder 120, an inner stator 148 disposed to be spaced inward from the outer stator 141, and a permanent magnet 146 disposed in a space between the outer stator 141 and the inner stator 148.

The permanent magnet 146 may linearly reciprocate by a mutual electromagnetic force between the outer stator 141 and the inner stator 148. Also, the permanent magnet 146 may be provided as a single magnet having one polarity or be provided by coupling a plurality of magnets having three polarities to each other.

The permanent magnet 146 may be disposed on the magnet frame 138. The magnet frame 138 may have an approximately cylindrical shape and be disposed to be inserted into the space between the outer stator 141 and the inner stator 148.

In detail, referring to the cross-sectional view of FIG. 6, the magnet frame 138 may be bent forward after extending from the outside in the radial direction from the rear side of the piston 130. The permanent magnet 146 may be installed on a front portion of the magnet frame 138. When the permanent magnet 146 reciprocates, the piston 130 may reciprocate together with the permanent magnet 146 in the axial direction.

The outer stator 141 includes coil winding bodies 141*b*, 141*c*, and 141*d* and a stator core 141*a*. The coil winding bodies 141*b*, 141*c*, and 141*d* include a bobbin 141*b* and a coil 141*c* wound in a circumferential direction of the bobbin 141*b*. The coil winding bodies 141*b*, 141*c*, and 141*d* further include a terminal part 141*d* that guides a power line connected to the coil 141*c* so that the power line is led out or exposed to the outside of the outer stator 141.

The stator core 141*a* includes a plurality of core blocks in which a plurality of laminations are laminated in a circumferential direction. The plurality of core blocks may be disposed to surround at least a portion of the coil winding bodies 141*b* and 141*c*.

A stator cover 149 may be disposed on one side of the outer stator 141. That is, the outer stator 141 may have one side supported by the frame 110 and the other side supported by the stator cover 149.

The linear compressor 10 further includes a cover coupling member 149*a* for coupling the stator cover 149 to the frame 110. The cover coupling member 149*a* may pass through the stator cover 149 to extend forward to the frame 110 and then be coupled to the frame 110.

The inner stator 148 is fixed to an outer circumference of the frame 110. Also, in the inner stator 148, the plurality of laminations are laminated outside the frame 110 in the circumferential direction.

The linear compressor 10 further includes a support 137 for supporting the piston 130. The support 137 may be coupled to a rear portion of the piston 130, and the muffler 150 may be disposed to pass through the inside of the support 137. Here, the piston 130, the magnet frame 138, and the support 137 may be coupled to each other by using a coupling member.

A balance weight 179 may be coupled to the support 137. A weight of the balance weight 179 may be determined based on a driving frequency range of the compressor body.

The linear compressor 10 further include a rear cover 170 coupled to the stator cover 149 to extend backward. In detail, the rear cover 170 includes three support legs, and the three support legs may be coupled to a rear surface of the stator cover 149.

A spacer 181 may be disposed between the three support legs and the rear surface of the stator cover 149. A distance from the stator cover 149 to a rear end of the rear cover 170 may be determined by adjusting a thickness of the spacer 181.

Also, the rear cover 170 may be spring-supported by the support 137. Also, the rear side of the rear cover 170 may be supported by the second support device 185 that will be described later.

The linear compressor 10 further includes an inflow guide part 156 coupled to the rear cover 170 to guide an inflow of the refrigerant into the muffler 150. At least a portion of the inflow guide part 156 may be inserted into the suction muffler 150.

The linear compressor 10 further includes a plurality of resonant springs 176*a* and 176*b* that are adjusted in natural frequency to allow the piston 130 to perform a resonant motion. The plurality of resonant springs 176*a* and 176*b* include a first resonant spring 176*a* supported between the support 137 and the stator cover 149 and a second resonant spring 176*b* supported between the support 137 and the rear cover 170.

The driving part that reciprocates within the linear compressor 10 may stably move by the action of the plurality of resonant springs 176*a* and 176*b* to reduce the vibration or noise due to the movement of the driving part. Also, the support 137 may include a first spring support part 137*a* coupled to the first resonant spring 176*a*.

The linear compressor 10 further includes a first support device 165 coupled to the discharge cover 160 to support one side of the main body of the compressor 10. The first support device 165 may be disposed adjacent to the second shell cover 103 to elastically support the main body of the compressor 10. In detail, the first support device 165 includes a first support spring 166. The first support spring 166 may be coupled to the spring coupling part 101*a*.

The linear compressor 10 further includes a second support device 185 coupled to the rear cover 170 to support the other side of the main body of the compressor 10. The second support device 185 may be coupled to the first shell cover 102 to elastically support the main body of the compressor 10. In detail, the second support device 185 includes a second support spring 186. The second support spring 186 may be coupled to the cover support part 102*a*.

Figure 7:
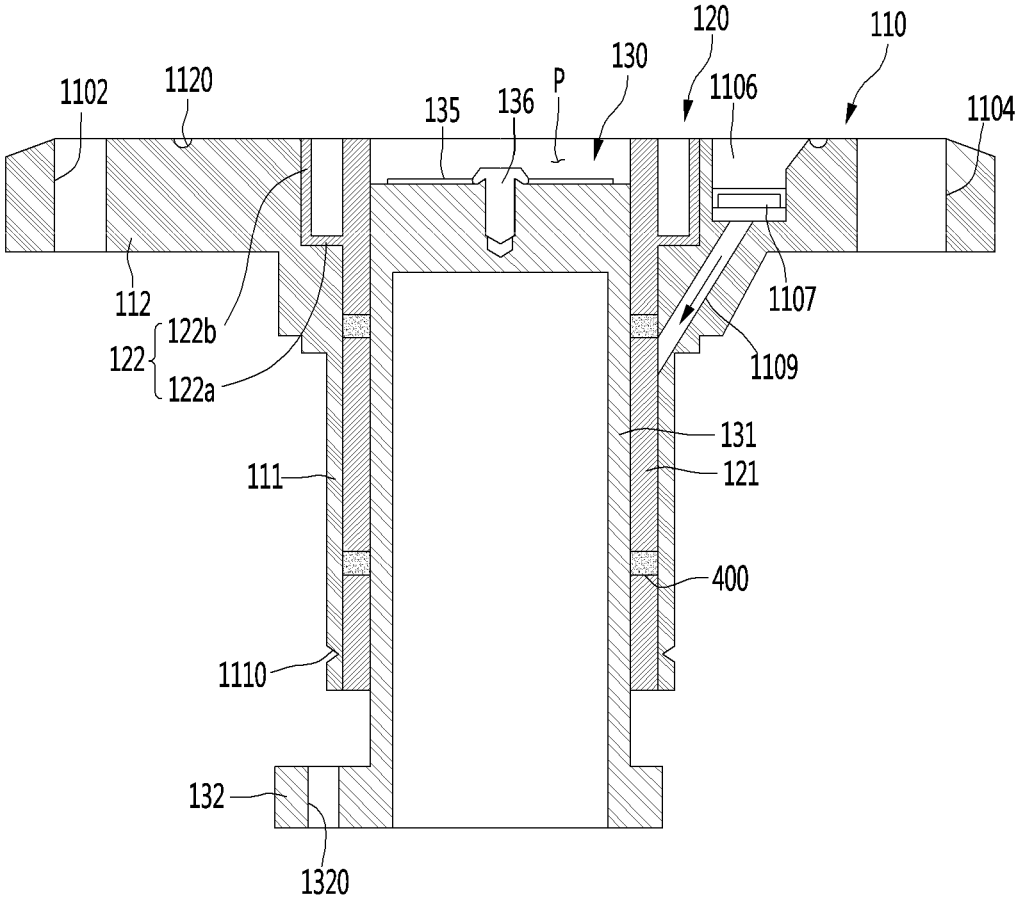
FIG. 7 is a view showing cross sections of the frame, the cylinder and the piston in FIG. 6 together with flow of bearing refrigerant.

FIG. 7 is a cross-sectional view of the frame, the cylinder, and the piston in FIG. 6 in addition to the flow of the bearing refrigerant. For convenience of description, the frame 110, the cylinder 120, and the piston 130 will be illustrated in FIG. 7, and also, other components will be omitted.

As illustrated in FIG. 7, the cylinder 120 is disposed inside the frame 110, and the piston 130 is disposed inside the cylinder 120.

The frame 110 includes a frame body 111 extending in the axial direction and a frame flange 112 extending outward from the frame body 111 in the radial direction. Here, the frame body 111 and the frame flange 112 may be integrated with each other.

The frame body 111 has a cylindrical shape of which upper and lower ends in the axial direction are opened. The cylinder 120 is accommodated inside the frame body 111 in the radial direction. The inner stator 148 is coupled to the outside of the frame body 111 in the radial direction, and also, the permanent magnet 146 and the outer stator 141 are disposed inside the frame body 111 in the radial direction.

The frame flange 112 have a circular plate shape having a predetermined thickness in the axial direction. Particularly, the frame flange 112 extends from a front end of the frame body 111 in the radial direction. Thus, the inner stator 148, the permanent magnet 146, and the outer stator 141, which are disposed outside the frame body 111 in the radial direction, may be disposed at a rear side of the frame flange 112 in the axial direction.

Also, a plurality of openings passing in the axial direction are defined in the frame flange 112. Here, the plurality of openings include a discharge coupling hole 1100 (see FIG. 3), a stator coupling hole 1102, and a terminal insertion hole 1104.

A predetermined coupling member (not shown) for coupling the discharge cover 160 to the frame 110 is inserted into the discharge coupling hole 1100. In detail, the coupling member (not shown) may be inserted to a front side of the frame flange 112 by passing through the discharge cover 160.

The cover coupling member 149*a* that is described above is inserted into the stator coupling hole 1102. The cover coupling member 149*a* may couple the stator cover 149 to the frame flange 112 to fix the outer stator 114 disposed between the stator cover 149 and the frame flange 112 in the axial direction.

The above-described terminal part 141*d* of the outer stator 141 may be inserted into the terminal insertion hole 1104. That is, the terminal part 141*d* may be withdrawn or exposed to the outside through the terminal insertion hole 1104 by passing from the rear side to the front side of the frame 110.

Here, each of the discharge coupling hole 1100, the stator coupling hole 1102, and the terminal insertion hole 1104 may be provided in plurality, which are sequentially disposed spaced apart from each other in the circumferential direction. For example, each of the discharge coupling hole 1100, the stator coupling hole 1102, and the terminal insertion hole 1104 may be provided in three, which are sequentially disposed at an angle of about 120 degrees in the circumferential direction.

Also, the terminal insertion holes 1104, the discharge coupling holes 1100, and the stator coupling holes 1102 are sequentially disposed to be spaced apart from each other in the circumferential direction. Also, the openings adjacent to each other may be disposed to be spaced an angle of about 30 degrees from each other in the circumferential direction.

For example, the respective terminal insertion holes 1104 and the respective discharge coupling holes 1100 are disposed spaced an angle of about 30 degrees from each other in the circumferential direction. Also, the respective discharge coupling holes 1100 and the respective stator coupling holes 1102 are disposed to be spaced an angle of about 30 degrees from each other in the circumferential direction. For example, the respective terminal insertion holes 1104 and the respective stator coupling holes 1102 are disposed spaced an angle of about 60 degrees from each other in the circumferential direction.

Also, the terminal insertion holes 1104, the discharge coupling holes 1100, and the stator coupling holes 1102 are arranged based on a center of the circumferential direction.

Also, a gas hole 1106 that is recessed backward from the front surface of the frame flange 112 is defined in the frame flange 112. Here, the refrigerant flowing to the gas hole 1106 may correspond to a portion of the refrigerant flowing from the compression space P to the discharge space D.

As described above, the refrigerant may correspond to a refrigerant that performs a function of a bearing. Thus, hereinafter, this refrigerant called a bearing refrigerant. That is to say, the bearing refrigerant may correspond to a portion of the refrigerant compressed in the compression space P and also correspond to a portion of the refrigerant flowing through the compressor 10.

Also, a bearing supply passage 1109 extending to pass from the frame flange 112 to the frame body 111 is provided in the frame 110. The bearing supply passage 1109 extends from the gas hole 1106 to an inner circumferential surface of the frame body 111. Thus, the bearing supply passage 1109 may be inclined in the radial direction and the axial direction.

Also, a gas filter 1107 for filtering foreign substances contained in the bearing refrigerant may be mounted on the gas hole 1106. For example, the gas hole 1106 may have a cylindrical shape. Also, the gas filter 1107 may be provided as a circular filter and disposed at a rear end of the gas hole 1106 in the axial direction.

Also, various installation grooves into which a sealing member for increasing coupling force between components is inserted may be provided in the frame 110. Also, an installation groove into a sealing member is inserted may be provided in a peripheral component coupled to the frame 110.

For example, a first installation groove 1120 that is recessed backward is provided in the front surface of the frame flange 112. The sealing member inserted into the first installation groove 1120 may be disposed between the frame 110 and the discharge cover 160 to prevent the refrigerant from leaking and increase the coupling force.

Also, a second installation groove 1110 that is recessed inward is provided in an outer circumferential surface of the frame body 111. The sealing member inserted into the second installation groove 1110 may increase coupling force between the frame 110 and the inner stator 148.

The cylinder 120 includes a cylinder body 121 extending in the axial direction and a cylinder flange 122 disposed outside a front portion of the cylinder body 121. The cylinder body 121 has a cylindrical shape with a central axis in the axial direction and is inserted into the frame body 111. Thus, an outer circumferential surface of the cylinder body 121 may be disposed to face an inner circumferential surface of the frame body 111.

The cylinder flange 122 includes a first flange 122*a* extending outward from a front portion of the cylinder body 121 in the radial direction and a second flange 122*b* extending forward from the first flange 122*a*. When the cylinder 120 is accommodated in the frame 110, the second flange 122*b* may be deformed to be press-fitted.

The cylinder body 121 may be provided with a bearing inflow passage 400 through which the bearing refrigerant flows. The bearing inflow passage 400 is formed to pass through the cylinder body 121 in the radial direction. That is, the bearing inflow passage 400 is formed to extend from the outer circumferential surface of the cylinder body 121 to the inner circumferential surface.

The piston 130 includes a piston body 131 having an approximately cylindrical shape and a piston flange 132 extending from the piston body 131 in the radial direction. The piston body 131 may reciprocate inside the cylinder 120, and the piston flange 132 may reciprocate outside the cylinder 120.

That is, the piston body 131 corresponds to a portion that is accommodated in the cylinder 120. The above-described suction hole 133 is defined in a front surface of the piston body 131. Also, the suction valve 135 is coupled to the front surface of the piston body 131 by the coupling member 136.

In detail, the suction valve 135 is fixed to a central portion of the front surface of the piston body 131. Also, an outer portion of the suction valve 135 may be bent forward by the reciprocating movement of the piston 130 to open the suction hole 133. Also, the refrigerant may flow to the compression space P through the suction hole 133.

The piston flange 132 may extend outward from the piston body 131 in the radial direction and be disposed at a rear side of the cylinder body 121. Also, a piston coupling hole 1320 into which a coupling member for coupling the magnet frame 138 to the support 137 is inserted may be provided in the piston flange 132. The piston coupling hole 1320 may be provided in plurality, which are spaced the same distance from each other in the circumferential direction.

Referring to the above-described structure, a flow of the bearing refrigerant, which is illustrated as an arrow in FIG. 7, will be described. As described above, the bearing refrigerant is understood as a portion of the refrigerant, which flows to the gas hole 1106, of the refrigerant discharged from the compression space P. Also, the bearing refrigerant may pass through the frame 110 through the bearing supply passage 1109 to flow to the outer circumferential surface of the cylinder 120.

The bearing refrigerant may flow to the outer circumferential surface of the piston 130 through the bearing inflow passage 400 to support the piston 130. In particular, the bearing inflow passage 400 may be provided in the shape of a pocket capable of receiving a predetermined refrigerant.

Therefore, the piston 130 may be supported by the pressure of refrigerant received in the bearing inflow passage 400. In addition, a plurality of bearing inflow passages 400 may be provided to support the piston 130.

In detail, the plurality of bearing inflow passages 400 may be provided to be spaced apart from one another in the circumferential direction. In particular, the plurality of bearing inflow passages 400 are arranged at equal intervals in the circumferential direction to stably support the outer circumferential surface of the piston 130. Hereinafter, a plurality of bearing inflow passages 400 spaced in the circumferential direction are classified into N arc bearing inflow passages (N is a natural number greater than 1).

In addition, a plurality of bearing inflow passages 400 may be provided to be spaced apart from one another in the axial direction. By supporting the piston 130 in the axial direction, it is possible to prevent the piston 130 from twisting around the axial direction. The plurality of axially spaced bearing inflow passages 400 may be classified into a front bearing inflow passage and a rear bearing inflow passage.

The front bearing inflow passage and the rear bearing inflow passage are provided as N arc bearing inflow passages. In this case, the number of the bearing inflow passages 400 circumferentially or axially spaced apart from one another is illustrative and may vary depending on a design.

The shapes of the bearing inflow passage 400 according to various embodiments and the bearing side passage 500 will be described. For convenience of description, the same reference numerals are used for configurations (the bearing inflow passage and the bearing side passage) that have the same function even when they have different shapes.

Figure 8:
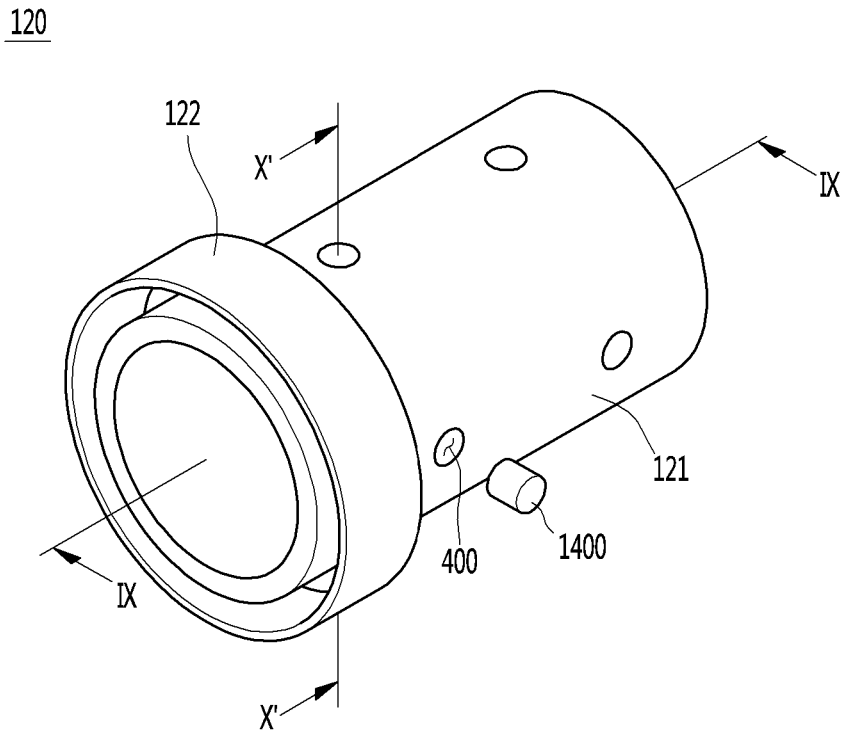
FIG. 8 is a view showing a cylinder of a linear compressor according to a first embodiment of the present invention.

FIG. 8 is a view showing a cylinder of a linear compressor according to a first embodiment of the present invention. Also, FIG. 9 is a cross-sectional view taken along line IX-IX' of FIG. 8, and FIG. 10 is a cross-sectional view taken along line X-X' of FIG. 8.

Figure 9:
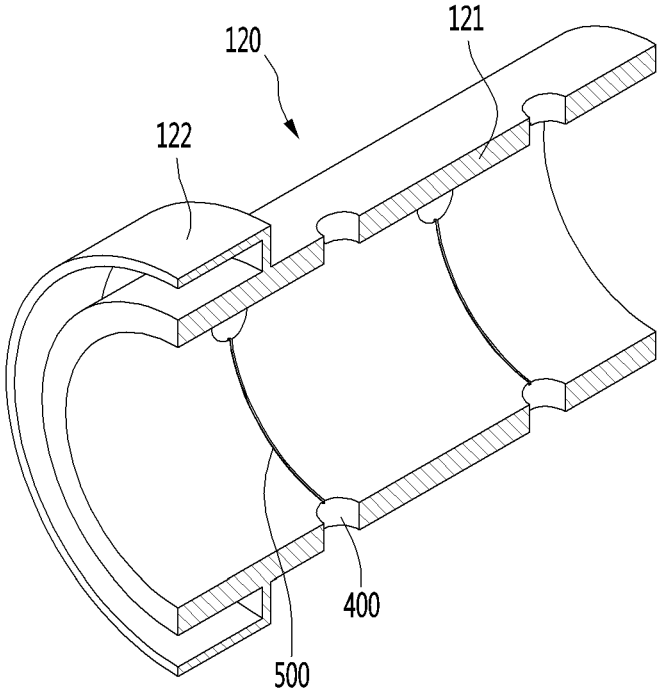
FIG. 9 is a cross-sectional view taken along line IX-IX' of FIG. 8.
Figure 10:
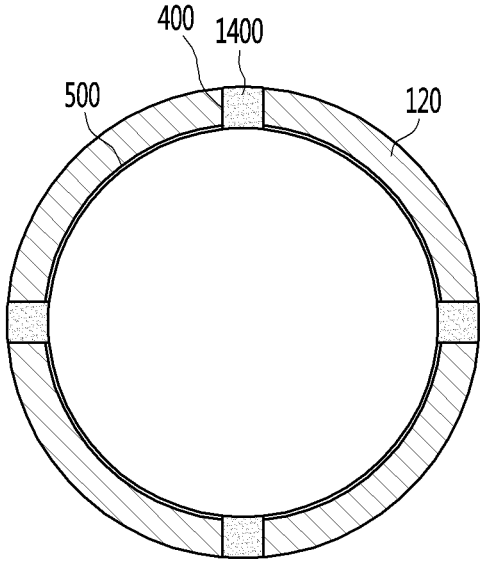
FIG. 10 is a cross-sectional view taken along line X-X' of FIG. 8.

As shown in FIGS. 8 to 10, a porous member 1400 is installed in a bearing inflow passage 400 of a linear compressor according to the first embodiment. The porous member 1400 may be understood as a configuration that controls the amount of refrigerant flowing into the bearing inflow passage 400.

As described above, the bearing refrigerant is a part of refrigerant flowing in a system, and there is a need to minimize the amount of the bearing refrigerant. Therefore, it is possible to control the amount of refrigerant through the porous member 1400 to secure a required supporting force with a small amount of refrigerant. For example, the porous member 1400 may include a fabric material.

In addition, the bearing inflow passage 400 is formed in such a way that an inlet end formed in the outer circumferential surface of the cylinder 120 and an outlet end formed in the inner circumferential surface of the cylinder 120 pass through the cylinder 120 with the same size. In other words, the bearing inflow passage 400 is formed to pass through the cylinder 120 in a cylindrical shape extending in the radial direction.

The porous member 1400 may be provided to have a shape corresponding to the bearing inflow passage 400. That is, the porous member 1400 may be provided in a cylindrical shape. In addition, the porous member 1400 may be press-fitted into and coupled to the bearing inflow passage 400.

The bearing inflow passage 400 is formed by a front bearing inflow passage and a rear bearing inflow passage, which are axially spaced apart from each other. The front bearing inflow passage and the rear bearing inflow passage each include four arc bearing inflow passages. As a result, eight bearing inflow passages 400 are formed in the cylinder 120.

Since the bearing inflow passages 400 are spaced apart from each other, the bearing refrigerant flows into the bearing inflow passages 400. That is, the bearing refrigerant may be divided into the eight bearing inflow passages 400 and flows from the outer circumferential surface to inner circumferential surface of the cylinder 120. The number of such bearing inflow passages 400 is understood to be exemplary.

The bearing refrigerant may be received in each bearing inflow passages 400 to support the outer circumferential surface of the piston 130. In this case, a bearing side passage 500 that circulates the bearing refrigerant in the circumferential direction is provided. More specifically, the bearing side passage 500 connects the bearing inflow passages 400 in the inner circumferential surface of the cylinder 120.

Accordingly, a part of the refrigerant received in the bearing inflow passage 1204 flows through the bearing side passage 500 in the circumferential direction. Further, the refrigerant flowing into the bearing inflow passages 400 communicate with each other through the bearing side passage 500.

As shown in FIG. 9, the bearing side passage 500 connects bearing inflow passages 1204 formed adjacent to the circumferential direction. In particular, the bearing side passage 500 is formed to be a groove extending in the circumferential direction. Referring to FIG. 10, the bearing side passage 500 is formed to be a ring-shaped groove as a whole.

In addition, the bearing side passage 500 is formed to be a very narrow passage as compared with the bearing inflow passage 1204. That is, the bearing side passage 500 is formed to induce the flow of a small amount of refrigerant. Accordingly, the piston 130 may be supported all in the circumferential direction.

Figure 11:
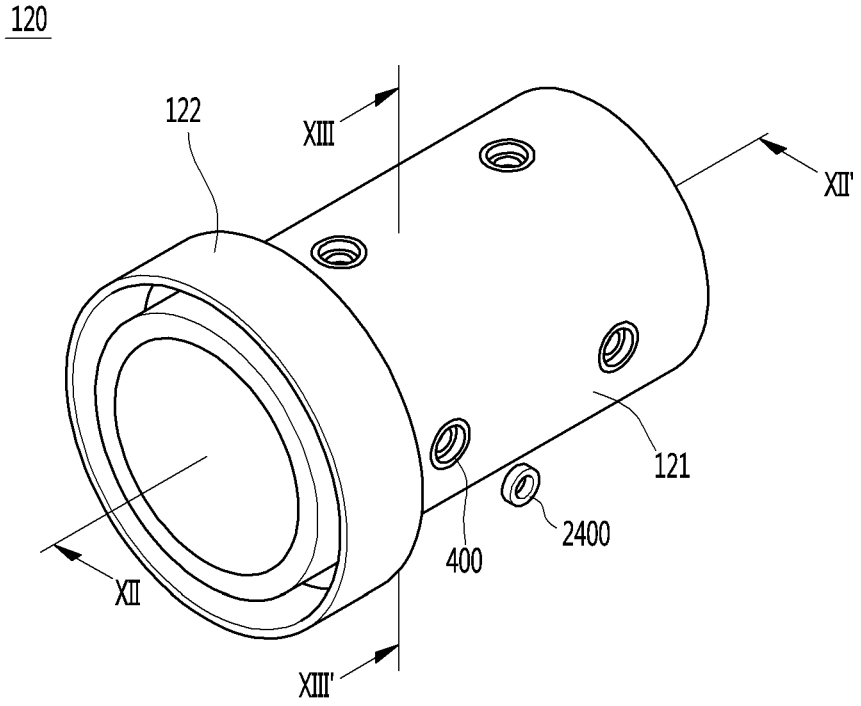
FIG. 11 is a view showing a cylinder of a linear compressor according to a second embodiment of the present invention.
Figure 12:
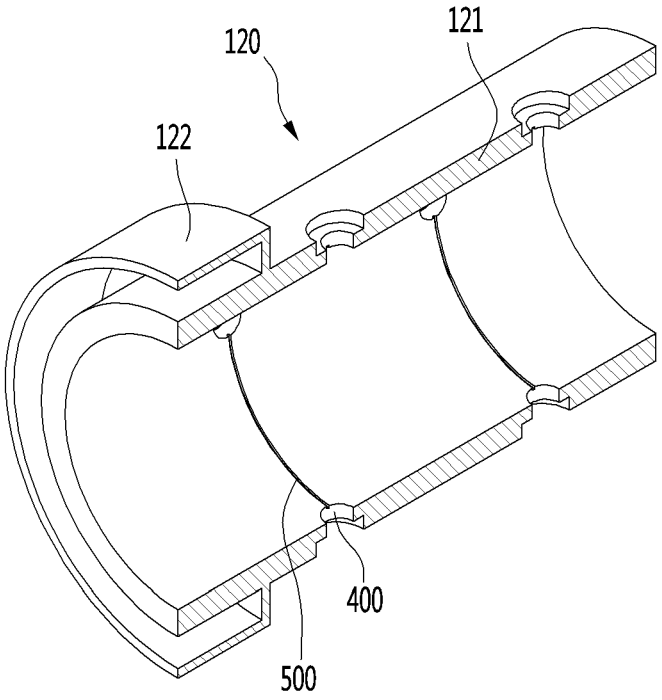
FIG. 12 is a cross-sectional view taken along line XII-XII' of FIG. 11.

FIG. 11 is a view showing a cylinder of a linear compressor according to a second embodiment of the present invention. FIG. 12 is a cross-sectional view taken along the line XII-XIII' of FIG. 11, and FIG. 13 is a cross-sectional view taken along line XIII-XIII' of FIG. 11.

Figure 13:
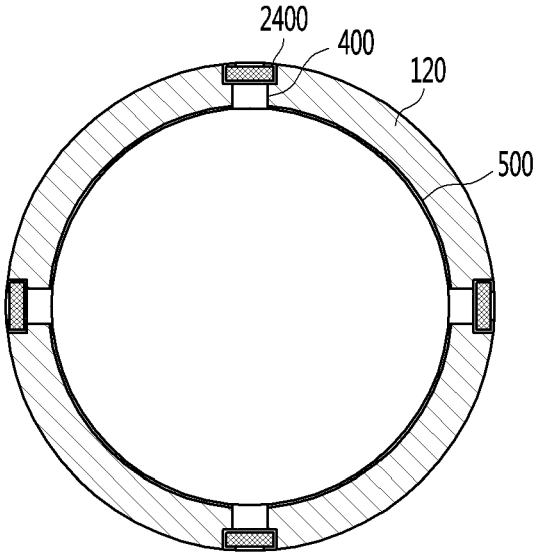
FIG. 13 is a cross-sectional view taken along line XIII-XIII' of FIG. 11.

As shown in FIGS. 11 to 13, a bearing filter 2400 is installed in a bearing inflow passage 400 of a linear compressor according to a second embodiment. The bearing filter 2400 may be understood as a configuration to filter out foreign substances contained in the bearing refrigerant.

As described above, the bearing refrigerant is a part of the refrigerant flowing in the system and may include foreign substances. When the foreign substances are introduced into between the piston 130 and the cylinder 120, the foreign substances may interfere with the driving of the piston 130. In addition, the flow of the refrigerant in the bearing may be blocked, so that the function of the bearing may not performed in a part thereof.

Accordingly, the bearing filter 2400 is provided to filter out foreign matter or oil contained in the bearing refrigerant. For example, the bearing filter 2400 may be made of a metal material such as stainless steel. In addition, the bearing filter 2400 may have a predetermined magnetic property as such a metal material and prevent the phenomenon of rusting. In addition, the bearing filter 2400 may be formed of a mesh type having a plurality of filter holes.

The bearing inflow passage 400 is formed into a cylindrical shape extending in the radial direction to pass through the cylinder 120. In addition, the bearing inflow passage 400 is formed to pass through the cylinder 120 and to be stepped such that an inlet end formed in the outer circumferential surface of the cylinder and an outlet end formed in the inner circumferential surface of the cylinder 120 have different sizes.

Particularly, the bearing inflow passage 400 has a larger inlet end than the outlet end such that the bearing filter 2400 is seated on the outer circumferential surface of the cylinder 120. The bearing filter 2400 may have a shape corresponding to an inlet end of the bearing inflow passage 400. That is, the bearing filter 2400 may be formed into a disc shape.

Accordingly, the refrigerant filtered through the bearing filter 2400 may be supplied to the inner circumferential surface of the cylinder 120. The number and arrangement of the bearing inflow passages 400 and the bearing side passage 500 may be the same as those of the first embodiment. Therefore, the description of FIGS. 8 to 10 will be referred to and the description will be omitted.

Figure 14:
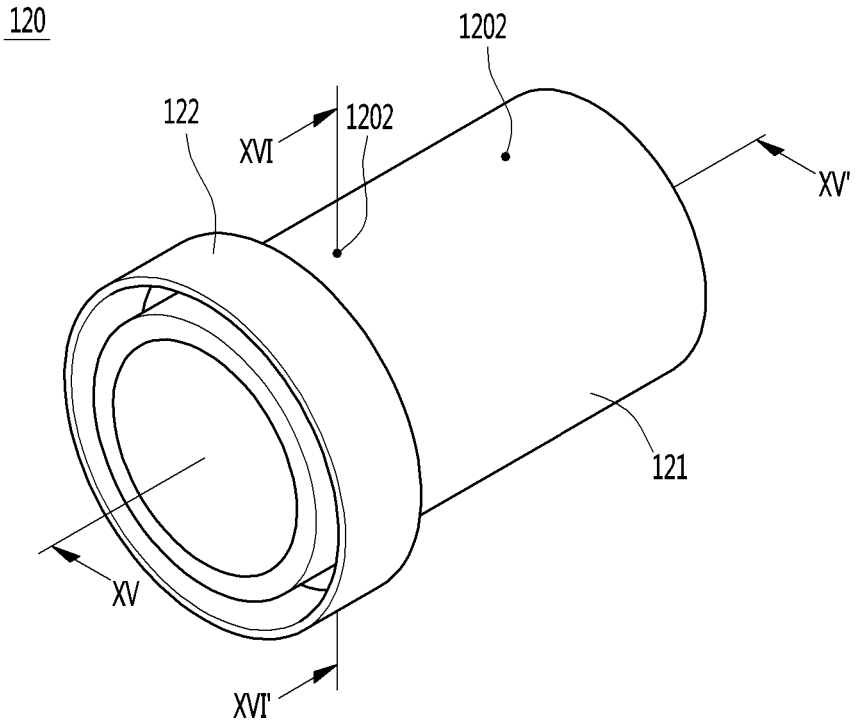
FIG. 14 is a view showing a cylinder of a linear compressor according to a third embodiment of the present invention.

FIG. 14 is a view showing a cylinder of a linear compressor according to a third embodiment of the present invention. Also, FIG. 15 is a cross-sectional view taken along line XV-XV' of FIG. 14, and FIG. 16 is a cross-sectional view taken along line XVI-XVI' of FIG. 14.

Figure 15:
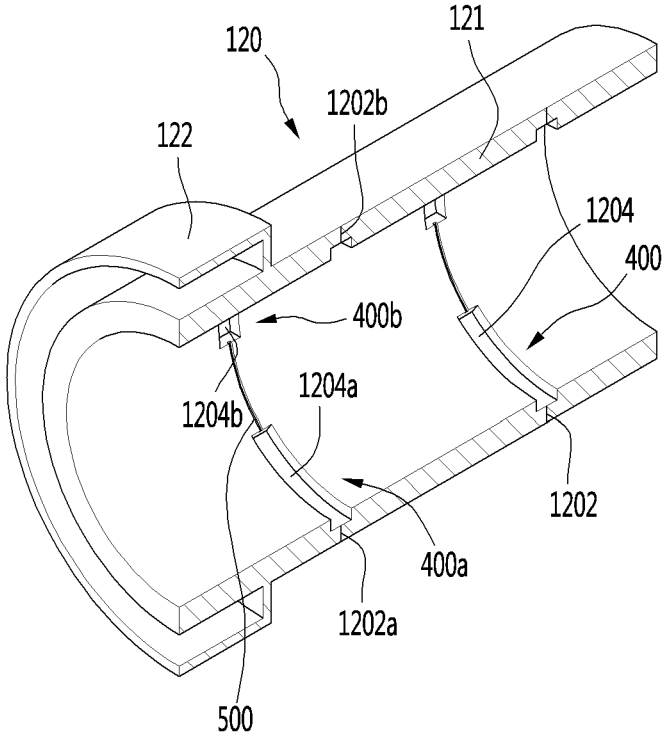
FIG. 15 is a cross-sectional view taken along line XV-XV' of FIG. 14.
Figure 16:
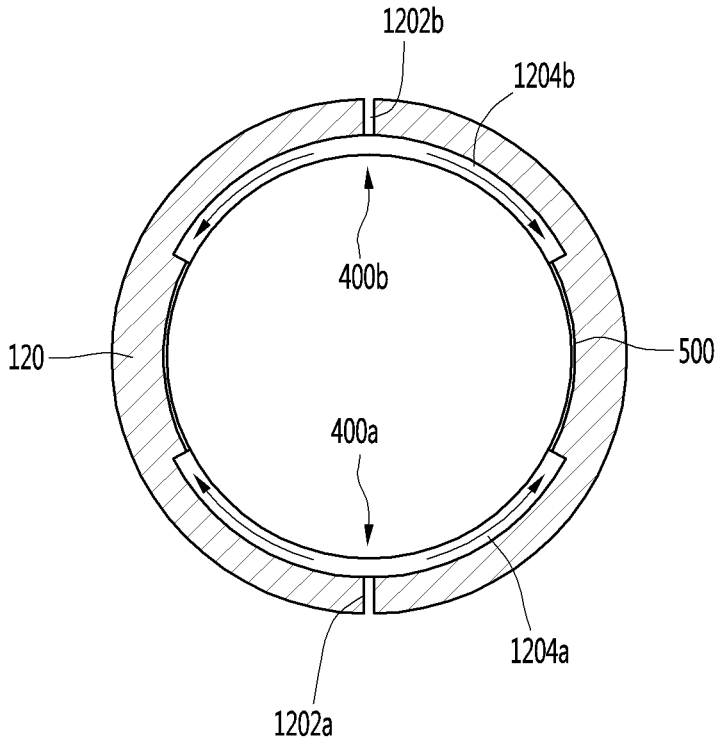
FIG. 16 is a cross-sectional view taken along line XVI-XVI' of FIG. 14.

As shown in FIGS. 14 to 16, the bearing inflow passage 400 is formed to pass through the cylinder 120 in the radial direction. That is, the bearing inflow passage 400 if formed to extend from the outer circumferential surface to inner circumferential surface of the cylinder 120.

The bearing inflow passage 400 includes a first bearing inflow passage 1202 extending inward from an inlet end formed in the outer circumferential surface of the cylinder 120 and a second bearing inflow passage 1204 extending from the first bearing inflow passage 1202 to an outlet end formed in the inner circumferential surface of the cylinder 120.

Therefore, the bearing refrigerant flows through the first bearing inflow passage 1202 and the second bearing inflow passage 1204 in order.

In particular, the bearing refrigerant flows from the outside to the inside through the first bearing inflow passage 1202 in the radial direction. In other words, the first bearing inflow passage 1202 corresponds to a passage extending in the radial direction. In detail, the first bearing inflow passage 1202 extends radially inward from the outer circumferential surface of the cylinder 120.

In this case, the first bearing inflow passage 1202 may be referred to as an orifice having a very narrow cross-sectional area. That is, the first bearing inflow passage 1202 may be understood as a structure for limiting the amount of the refrigerant flowing through the bearing inflow passage 400. In other words, a very small amount of refrigerant is capable of flowing through the first bearing inflow passage 1202.

Also, the bearing refrigerant flows in the circumferential direction through the second bearing inflow passage 1204. In other words, the second bearing inflow passage 1204 corresponds to a passage extending in the circumferential direction. In particular, the second bearing inflow passage 1204 is formed to be recessed radially outward in the inner circumferential surface of the cylinder 120.

In this case, the cross-sectional area of the first bearing inflow passage 1202 is smaller than the cross-sectional area of the second bearing inflow passage 1204. That is, the cross-sectional area of the second bearing inflow passage 1204 is very wide as compared with the cross-sectional area of the first bearing inflow passage 1202.

The second bearing inflow passage 1204 may receive the bearing refrigerant introduced through the first bearing inflow passage 1202. In this case, the second bearing inflow passage 1204 may be referred to as a pocket in which the bearing refrigerant is received. In addition, the piston 130 may be supported through the bearing refrigerant received in the second bearing inflow passage 1204.

As illustrated in FIGS. 14 to 16, the bearing inflow passage 400 is provided in plurality in the cylinder 120. In detail, the bearing inflow passage 400 may be provided in plurality in the axial direction. The number of bearing inflow passage 400 and a distance spaced between the bearing inflow passages 400 may be merely illustrative.

FIGS. 14 to 16 illustrate a pair of bearing inflow passages 400 spaced apart from each other in the axial direction. For convenience of description, the front bearing inflow passage disposed at a front side in the axial diction and the rear bearing inflow passage disposed at a rear side in the axial direction may be divided. Here, the front bearing inflow passage may be disposed behind the cylinder flange 122 in the axial direction.

Also, the bearing inflow passage 400 may be provided in plurality in the circumferential direction. FIGS. 14 to 16 illustrate a pair of bearing inflow passages 400 spaced apart from each other in the circumferential direction. Here, the pair of bearing inflow passages 400 are divided into a first arc bearing inflow passage 400*a* and a second arc bearing inflow passage 400*b*.

Also, the pair of arc bearing inflow passages 400*a* and 400*b*, which are spaced apart from each other in the circumferential direction, are disposed on the same plane in the axial direction and disposed to be opposite to each other in the radial direction.

Also, the front bearing inflow passage and the rear bearing inflow passage include the pair of arc bearing inflow passages 400*a* and 400*b*, respectively. Thus, total four bearing inflow passages 400 may be provided in the cylinder 120.

In summary, at least portions of the bearing inflow passages 400 may be disposed on the same planes in the axial direction, and at least portions may be disposed spaced apart from each other in the circumferential direction. Also, at least portions of the bearing inflow passages 400 may be disposed to be opposite to each other in the radial direction. Also, at least portions of the bearing inflow passages 400 may be disposed spaced apart from each other in the axial direction.

Here, since the front bearing inflow passage and the rear bearing inflow passage have the same shape, one of the front and rear bearing inflow passages will be described. Thus, the plurality of arc bearing inflow passages 400*a* and 400*b* disposed on the same plane in the axial direction will be described.

Each of the arc bearing inflow passages 400*a* and 400*b* includes the first bearing inflow passage 1202 and the second bearing inflow passage 1204. That is, the pair of first bearing inflow passages 1202 spaced apart from each other in the circumferential direction and the pair of second bearing inflow passages 1204 spaced apart from each other in the circumferential direction may be provided.

Here, the first bearing inflow passage 1202 of the first arc bearing inflow passages 400*a* is called a first orifice 1202*a*, and the first bearing inflow passage 1202 of the second arc bearing inflow passages 400*b* is called a second orifice 1202*b*. Also, the second bearing inflow passage 1204 of the second arc bearing inflow passages 400*a* is called a second pocket 1204*a*, and the second bearing inflow passage 1204 of the second arc bearing inflow passages 400*b* is called a second pocket 1204*b*.

The first orifice 1202*a* and the second orifice 1202*b* may be disposed in the same line in the radial direction. That is, the pair of orifices 1202*a* and 1202*b* are disposed spaced a minimum distance from each other in the circumferential direction. Here, referring to FIG. 15, since the orifice 1202 has a very narrow passage or cross-sectional area, the orifice 1202 may be illustrated in the cylinder 120 as a line extending in the radial direction.

Also, for convenience of description, in FIGS. 14 and 16, the cross-sectional area of the orifice 1202 is illustrated to be slightly enlarged. In detail, in FIG. 14, the orifice 1202 is illustrated as a hole defined in the outer circumferential surface of the cylinder 120. Also, in FIG. 16, the orifice 1202 is illustrated as a path defining a predetermined passage.

Referring to FIGS. 15 and 16, the pocket 1204 extends to both sides of the circumferential direction by using the orifice 1202 as a center. Here, the pair of pockets 1204*a* and 1204*b* extend from the pair of orifices 1202*a* and 1202*b* so as to be close to each other, respectively.

Also, the pocket 1204 has a rectangular cross-section. That is to say, the pocket 1204 is recessed in a rectangular shape from the inner circumferential surface of the cylinder 120. That is to say, the pocket 1204 extends in a rectangular shape from the inner circumferential surface of the cylinder 120 in the circumferential direction.

Particularly, the pocket 1204 may extend in the form of the same cross-section in the circumferential direction. Thus, the pocket 1204 may have both ends that are recessed in the same rectangular shape.

Here, as the pocket 1204 extends in the circumferential direction, the piston 130 may be effectively supported. That is to say, the pocket 1204 may extend in the circumferential direction to surround the outer circumferential surface of the piston 130, thereby supporting the piston 130.

However, the first pocket 1204*a* and the second pocket 1204*b* are disposed to be spaced apart from each other. If the first pocket 1204*a* and the second pocket 1204*b* contact each other, an inner pressure of each of the first pocket 1204*a* and the second pocket 1204*b* is reduced. That is, a pressure for supporting the piston 130 is reduced.

As a result, the first pocket 1204*a* and the second pocket 1204*b* are disposed to be spaced apart from each other and extend in the circumferential direction. Thus, the inner circumferential surface of the cylinder 120, in which the pocket 1204 is provided, may have an uneven structure in the circumferential direction.

FIG. 16 illustrates the flow c of the bearing refrigerant through the pocket 1204. As illustrated in FIG. 9, the refrigerant introduced into the orifice 1202 may flow along the pocket 1204 in the circumferential direction. That is, the bearing refrigerant may be filled into the pocket 1204 that is recessed from the inner circumferential surface of the cylinder 120.

Hereafter, referring to FIG. 16, force for supporting the piston 130 through the bearing refrigerant accommodated in the pocket 1204 will be described in detail. The piston 130 is movably accommodated in the cylinder 120. Here, the cylinder 120 is fixed to the frame 110, and the piston 130 reciprocates.

Thus, each of the inner circumferential surface of the cylinder 120 and the outer circumferential surface of the piston 130 may be designed to have a predetermined tolerance so that the piston 130 is movable. Also, the piston 130 may be eccentric to one side within the cylinder 120 according to the reciprocation or design of the piston 130.

For example, it is assumed that the piston 130 is eccentric to the first arc bearing inflow passage 400*a*. Thus, the refrigerant accommodated in the first pocket 1204*a* is subjected to a relatively high pressure, and the refrigerant accommodated in the second pocket 120*b* is subjected to a relatively low pressure.

That is, a difference in pressure between the first pocket 1204*a* and the second pocket 1204*b* occurs. Thus, the piston 130 may be subjected to support force at which the piston 130 is away from the first pocket 1204*a* and close to the second pocket 1204*b*. Thus, a central axis of the piston 130 may be fixed, and friction between the piston 130 and the cylinder 120 may be prevented.

In this case, a bearing side passage 500 for causing the bearing refrigerant to flow in the circumferential direction is provided. Specifically, the bearing side passage 500 connects the bearing inflow passages 400 in the inner circumferential surface of the cylinder 120. In particular, the bearing side passage 500 is formed to extend from the second bearing inflow passage 1204 in the circumferential direction.

Accordingly, a part of the refrigerant received in the second bearing inflow passage 1204 flows through the bearing side passage 500 in the circumferential direction. That is, the bearing side passage 500 is formed to connect the pockets 1204*a* and 1204*b*, spaced apart from each other in the circumferential direction, to each other. Accordingly, refrigerant that has flowed into the first pocket 1204*a* and refrigerant that has flowed into the second pocket 1204*b* communicate with each other through the bearing side passage 500.

As shown in FIG. 15, the bearing side passage 500 connects second bearing inflow passages 1204 formed adjacent to the circumferential direction. In particular, the bearing side passage 500 is formed to be a groove extending in the circumferential direction. Referring to FIG. 16, the bearing side passage 500 is formed to be a ring-shaped groove as a whole.

In addition, the bearing side passage 500 is formed to be a very narrow passage as compared with the second bearing inflow passage 1204. That is, the bearing side passage 500 is formed to induce the flow of a small amount of refrigerant. Accordingly, the piston 130 may be supported all in the circumferential direction.

In this case, the bearing side passage 500 is formed to be wider than the first bearing inflow passage 1202. The first bearing inflow passage 1202. The first bearing inflow passage 1204 is formed for the flow resistance of the refrigerant and the bearing side passage 500 is formed to induce flow of a small amount of refrigerant. However, they may be formed differently depending on a design.

Figure 17:
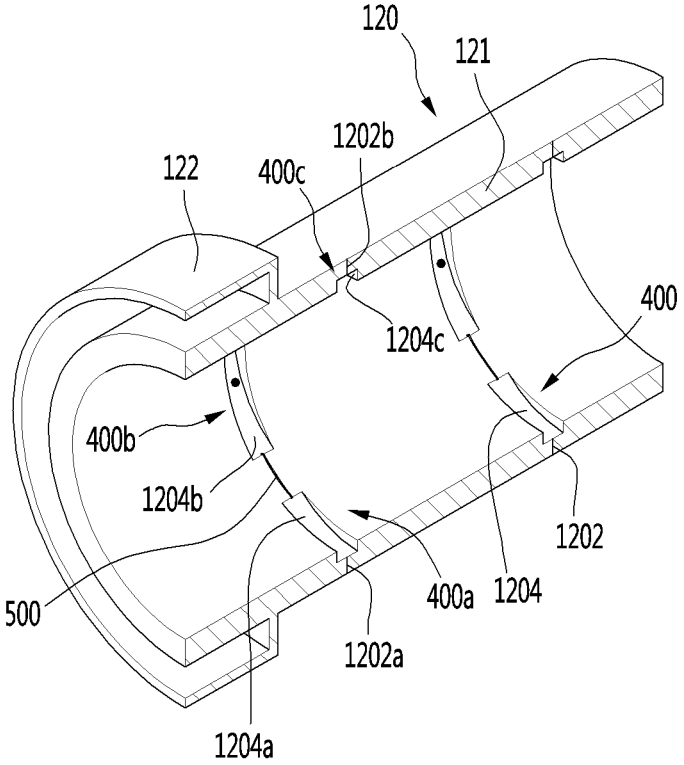
FIG. 17 is a cross-sectional view taken along line XV-XV' of FIG. 14 according to another embodiment.
Figure 18:
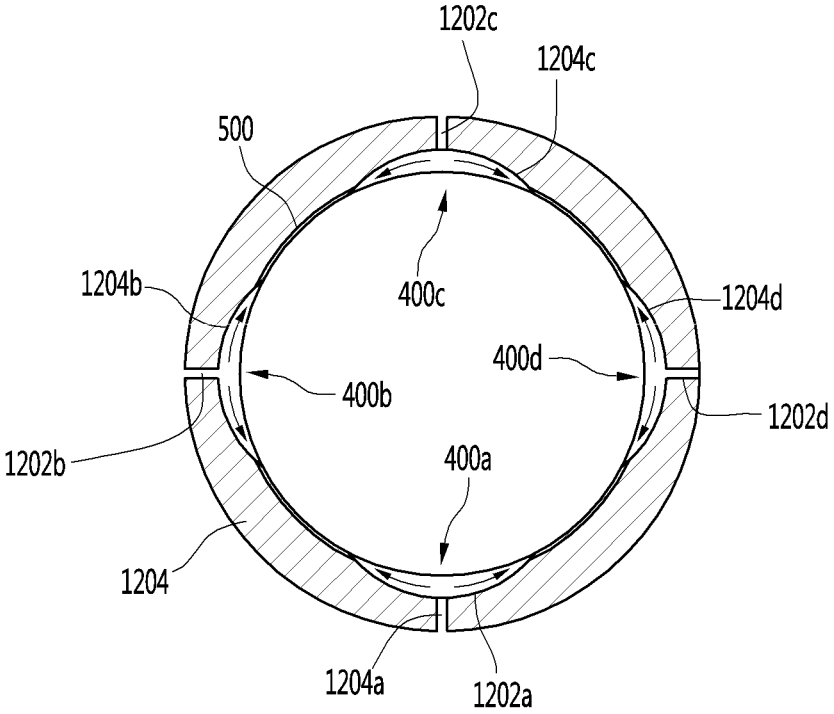
FIG. 18 is a cross-sectional view taken along line XVI-XVI' of FIG. 14 according to another embodiment.

FIG. 17 is a cross-sectional view taken along line XV-XV' of FIG. 14 according to another embodiment, and FIG. 18 is a cross-sectional view taken along line XVI-XVI' of FIG. 14 according to another embodiment.

FIGS. 17 to 18 illustrate 4 bearing inflow passages 400 spaced apart from each other in the circumferential direction. Here, the four bearing inflow passages 400 are divided into a first arc bearing inflow passage 400*a*, a second arc bearing inflow passage 400*b*, a third arc bearing inflow passage 400*c*, and a fourth arc bearing inflow passage 400*d* when viewed in a counterclockwise direction.

Also, the four arc bearing inflow passages 400*a*, 400*b*, 400*c*, and 400*d* are disposed on the same planes in the axial direction. Also, the first arc bearing inflow passage 400*a* and the third arc bearing inflow passage 400*c* may be disposed to face each other in the radial direction, and the second arc bearing inflow passage 400*b* and the fourth arc bearing inflow passage 400*d* may be disposed to face each other in the radial direction.

Also, the front bearing inflow passage and the rear bearing inflow passage include the four arc bearing inflow passages 400*a*, 400*b*, 400*c*, and 400*d*, respectively. Thus, total eight bearing inflow passages 400 may be provided in the cylinder 120.

Here, since the front bearing inflow passage and the rear bearing inflow passage have the same shape, one of the front and rear bearing inflow passages will be described. Thus, the plurality of arc bearing inflow passages 400*a*, 400*b*, 400*c*, and 400*d* disposed on the same plane in the axial direction will be described.

Each of the arc bearing inflow passages 400*a*, 400*b*, 400*c*, and 400*d* includes the first bearing inflow passage 1202 and the second bearing inflow passage 1204. That is, the four first bearing inflow passages 1202 spaced apart from each other in the circumferential direction and the four second bearing inflow passages 1204 spaced apart from each other in the circumferential direction may be provided.

Here, the first bearing inflow passage 1202 of the first arc bearing inflow passages 400*a* is called a first orifice 1202*a*, and the first bearing inflow passage 1202 of the second arc bearing inflow passages 400*b* is called a second orifice 1202*b*. Also, the first bearing inflow passage 1202 of the third arc bearing inflow passages 400*c* is called a third orifice 1202*c*, and the first bearing inflow passage 1202 of the fourth arc bearing inflow passages 400*d* is called a fourth orifice 1202*d*.

Also, the second bearing inflow passage 1204 of the second arc bearing inflow passages 400*a* is called a second pocket 1204*a*, and the second bearing inflow passage 1204 of the second arc bearing inflow passages 400*b* is called a second pocket 1204*b*. Also, the second bearing inflow passage 1204 of the third arc bearing inflow passages 400*c* is called a third pocket 1204*c*, and the second bearing inflow passage 1204 of the fourth arc bearing inflow passages 400*d* is called a fourth pocket 1204*d*.

The orifices 1202*a*, 1202*b*, 1202*c*, and 1202*d* may be disposed to be spaced a maximum distance from each other in the circumferential direction. That is, the orifices 1202*a*, 1202*b*, 1202*c*, and 1202*d* may be disposed to be spaced an angle of about degrees from each other in the circumferential direction. Thus, the first orifice 1202*a* and the third orifice 1202*c* may be disposed in the same line in the radial direction, and the second orifice 1202*b* and the fourth orifice 1202*d* may be disposed in the same line in the radial direction.

Here, referring to a cross-section of FIG. 17, since the orifice 1202 has a very narrow passage or cross-sectional area, the orifice 1202 may be illustrated in the cylinder 120 as a line extending in the radial direction. Also, for convenience of description, the orifice 1202 is illustrated as a hole in FIG. 17 and illustrated as a path defining a predetermined passage in FIG. 18.

Referring to FIGS. 17 and 18, the pocket 1204 extends to both sides of the circumferential direction by using the orifice 1202 as a center. Here, the pockets 1204*a*, 1204*b*, 1204*c*, and 1204*d* extend close to the orifices 1202*a*, 1202*b*, 1202*c*, and 1202*c*, respectively.

Also, the pocket 1204 has a rectangular cross-section. That is to say, the pocket 1204 is recessed in a rectangular shape from the inner circumferential surface of the cylinder 120. Particularly, the pocket 1204 extends from the inner circumferential surface of the cylinder 120 so that the cross-section of the pocket 1204 varies in the circumferential direction.

In detail, the pocket 1204 may extend in the circumferential direction so that the cross-section of the pocket 1204 gradually decreases with respect to the orifice 1202. Thus, as illustrated in FIG. 18, the cross-section of the pocket 1204 in the circumferential direction may have a crescent shape.

Here, as the pocket 1204 extends in the circumferential direction, the piston 130 may be effectively supported. That is to say, the pocket 1204 may extend in the circumferential direction to surround the outer circumferential surface of the piston 130, thereby supporting the piston 130.

The pockets 1204*a*, 1204*b*, 1204*c*, and 1204*d* are disposed to be spaced apart from each other. If the pockets adjacent to each other in the circumferential direction contact each other, an inner pressure of each of the pockets may be reduced. That is, a pressure for supporting the piston 130 is reduced.

As a result, the pockets 1204*a*, 1204*b*, 1204*c*, and 1204*d* are disposed to be spaced apart from each other and extends in the circumferential direction. Thus, the inner circumferential surface of the cylinder 120, in which the pocket 1204 is provided, may have an uneven structure in the circumferential direction.

FIG. 18 illustrates the flow c of the bearing refrigerant through the pocket 1204. As illustrated in FIG. 9, the refrigerant introduced into the orifice 1202 may flow along the pocket 1204 in the circumferential direction. That is, the bearing refrigerant may be filled into the pocket 1204 that is recessed from the inner circumferential surface of the cylinder 120.

Hereafter, referring to FIG. 18, force for supporting the piston 130 through the bearing refrigerant accommodated in the pocket 1204 will be described in detail. The piston 130 is movably accommodated in the cylinder 120. Also, each of the inner circumferential surface of the cylinder 120 and the outer circumferential surface of the piston 130 may be designed to have a predetermined tolerance so that the piston 130 is movable.

The piston 130 may be eccentric to one side within the cylinder 120 according to the reciprocation or design of the piston 130. For example, it is assumed that the piston 130 is eccentric to the first arc bearing inflow passage 400*a* and the second arc bearing inflow passage 400*b*.

Thus, the refrigerant accommodated in the first pocket 1204*a* and the second pocket 1204*b* may be subjected to a relatively high pressure, and the refrigerant accommodated in the third pocket 1204*c* and the fourth pocket 1204*d* may be subjected to a relatively low pressure.

That is, a difference in pressure between the first and second pockets 1204*a* and 1204*b* and between the third and fourth pockets 1204*c* and 1204*d* occurs. Thus, the piston 130 may be subjected to support force at which the piston 1204*a* is away from the first and second pockets 1204*a* and 1204*b* and close to the third and fourth pockets 1204*c* and 1204*d*. Thus, a central axis of the piston 130 may be fixed, and friction between the piston 130 and the cylinder 120 may be prevented.

In this case, a bearing side passage 500 for causing the bearing refrigerant to flow in the circumferential direction is provided. Specifically, the bearing side passage 500 connects the bearing inflow passages 400 in the inner circumferential surface of the cylinder 120. In particular, the bearing side passage 500 is formed to extend from the second bearing inflow passage 1204 in the circumferential direction.

Accordingly, a part of the refrigerant received in the second bearing inflow passage 1204 flows through the bearing side passage 500 in the circumferential direction. That is, the bearing side passage 500 is formed to connect the pockets 1204*a*, 1204*b*, 1204*c*, and 1204*d*, spaced apart from one another in the circumferential direction, to one another. Accordingly, the refrigerant flowed into the first pocket 1204*a*, refrigerant flowed into the second pocket 1204*b*, refrigerant flowed into the third pocket 1204*c*, and refrigerant flowed into the fourth pocket 1204*d* communicate with one another through the bearing side passage 500.

As shown in FIG. 17, the bearing side passage 500 connects the second bearing inflow passages 1204 formed adjacent to each other in the circumferential direction. In particular, the bearing side passage 500 is formed to be a groove extending in the circumferential direction. Referring to FIG. 18, the bearing side passage 500 is formed to be a ring-shaped groove as a whole.

In addition, the bearing side passage 500 is formed to be a very narrow passage as compared with the second bearing inflow passage 1204. That is, the bearing side passage 500 is formed to induce the flow of a small amount of refrigerant. Accordingly, the piston 130 may be supported all in the circumferential direction.

Since the bearing side passage 500 is formed to be a very narrow passage as compared with the second bearing inflow passage 1204, the second bearing side passage 500 does not significantly affect the supporting force of the second bearing inflow passage 1204. That is, as the pockets spaced apart from each other do not contact each other and only a small amount of refrigerant flows, thereby preventing the internal pressure of each pocket from lowering.

In other words, it may be understood that the bearing side passage 500 induces a flow of the refrigerant not received in the bearing inflow passage 400. That is, the refrigerant spread widely between the piston 130 and the cylinder 120 collects to effectively support the piston 130.

Figure 19:
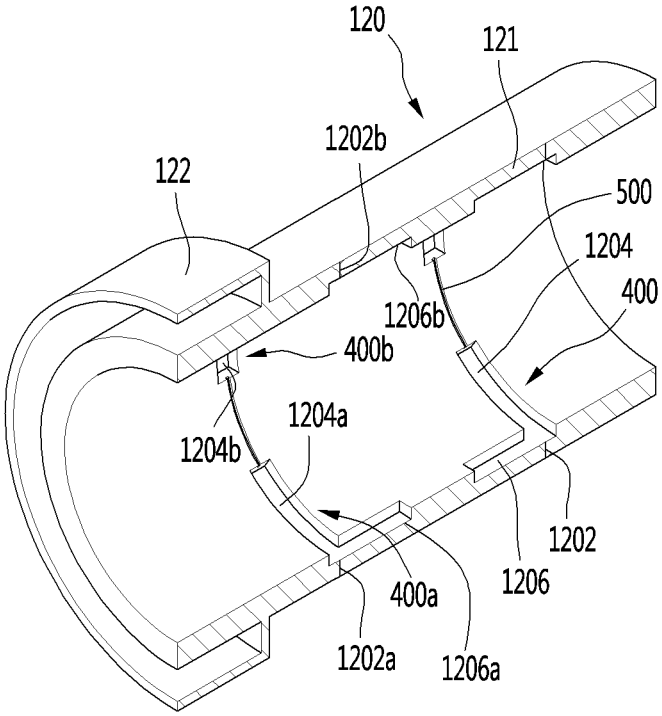
FIG. 19 is a cross-sectional view taken along line XV-XV' of FIG. 14 according to still another embodiment.

FIG. 19 is a cross-sectional view taken along line XV-XV' of FIG. 14 according to another embodiment.

FIG. 19 corresponds to an embodiment in which the bearing inflow passage 400 shown in FIG. 15 is partly modified. In addition, FIGS. 14 and 16 correspond to the same shape. Therefore, the difference will be described, and the common parts will be omitted and the above description will be referred to.

As shown in FIG. 19, a plurality of bearing inflow passages 400 are provided in the cylinder 120. In particular, a plurality of bearing inflow passages 400 may be provided to be spaced apart from one another in the circumferential direction.

As described above, the bearing inflow passage 400 includes the first bearing inflow passage 1202 and the second bearing inflow passage 1204. Also, the bearing inflow passage 400 further include a third bearing inflow passage 1206 extending from the first bearing inflow passage 1202 to the inner circumferential direction of the cylinder body 121.

The third bearing inflow passage 1206 is recessed outward from the inner circumferential surface of the cylinder 120 in the radial direction, like the second bearing inflow passage 1204. Also, the third bearing inflow passage 1206 extends in the axial direction. That is, the third bearing inflow passage 1206 is provided in the inner circumferential surface of the cylinder 120 in a direction perpendicular to the second bearing inflow passage 1204.

Here, the third bearing inflow passage 1206 may have the same cross-section as the second bearing inflow passage 1204. However, this is merely illustrative. Thus, the third bearing inflow passage 1206 and the second bearing inflow passage 1204 may be recessed in the cylinder 120 so as to have sizes and shapes different from each other.

Also, the third bearing inflow passage 1206 may accommodate the bearing refrigerant introduced through the first bearing inflow passage 1202. Thus, the third bearing inflow passage 1206 together with the second bearing inflow passage 1204 may be called a pocket in which the bearing refrigerant is accommodated. Also, the piston 130 may be supported by the bearing refrigerant accommodated in the second and third bearing inflow passages 1204 and 1206.

Hereinafter, the front bearing inflow passage provided as the pair of arc bearing inflow passages 400*a* and 400*b* will be described.

Each of the arc bearing inflow passages 400*a* and 400*b* includes the first bearing inflow passage 1202, the second bearing inflow passage 1204, and the third bearing inflow passage 1204. That is, the pair of first bearing inflow passages 1202 spaced apart from each other in the circumferential direction, the pair of second bearing inflow passages 1204 spaced apart from each other in the circumferential direction, and the pair of third bearing inflow passages 1206 spaced apart from each other in the circumferential direction may be provided.

Here, the first bearing inflow passage 1202 of the first arc bearing inflow passages 400*a* is called a first orifice 1202*a*, and the first bearing inflow passage 1202 of the second arc bearing inflow passages 400*b* is called a second orifice 1202*b*.

Also, the second bearing inflow passage 1204 and the third bearing inflow passage 1206 of the first arc bearing inflow passage 400*a* are called first pockets 1204*a* and 1206*a*. Also, for classification, the second bearing inflow passage 1204 may be called a first cover pocket 1204*a*, and the third bearing inflow passage 1206 may be called a first linear pocket 1206*a*.

Also, the second bearing inflow passage 1204 and the third bearing inflow passage 1206 of the second arc bearing inflow passage 400*b* are called second pockets 1204*b* and 1206*b*. Also, for classification, the second bearing inflow passage 1204 may be called a second cover pocket 1204*a*, and the third bearing inflow passage 1206 may be called a second linear pocket 1206*a*.

The first orifice 1202*a* and the second orifice 1202*b* may be disposed in the same line in the radial direction. That is, the pair of orifices 1202*a* and 1202*b* are disposed spaced a minimum distance from each other in the circumferential direction. Referring to FIG. 12, since the orifice 1202 has a very narrow passage or cross-sectional area, the orifice 1202 may be illustrated in the cylinder 120 as a line extending in the radial direction.

Referring to FIG. 19, the pockets 1204 and 1206 extend from the orifice 1202.

Also, each of the pockets 1204 and 1206 may have a rectangular cross-section. That is to say, each of the pockets 1204 and 4006 is recessed in a rectangular shape from the inner circumferential surface of the cylinder 120. That is to say, each of the pockets 1204 and 1206 extends in a rectangular shape from the inner circumferential surface of the cylinder 120.

Particularly, the pockets 1204, 1204 may extend in the form of the same cross-section. Thus, each of the pockets 1204 and 1206 may have an end recessed in the same rectangular shape. However, this is merely illustrative, and thus, the cross-section may extend to vary as described in the second embodiment.

The cover pocket 1204 extends from the orifice 1202 in the circumferential direction. Particularly, the cover pockets 1204*a* and 1204*b* extend from the pair of orifices 1202*a* and 1202*b* so as to be close to each other, respectively.

Here, as the cover pocket 1204 extends in the circumferential direction, the piston 130 may be effectively supported. That is to say, the cover pocket 1204 may extend in the circumferential direction to surround the outer circumferential surface of the piston 130, thereby supporting the piston 130.

However, the first cover pocket 1204*a* and the second cover pocket 1204*b* are disposed to be spaced apart from each other. If the first cover pocket 1204*a* and the second cover pocket 1204*b* contact each other, an inner pressure of each of the first cover pocket 1204*a* and the second curve pocket 1204*b* is reduced. That is, a pressure for supporting the piston 130 is reduced.

As a result, the first curve pocket 1204*a* and the second curve pocket 1204*b* are disposed to be spaced apart from each other and extend in the circumferential direction. Thus, the inner circumferential surface of the cylinder 120, in which the curve pocket 1204 is provided, may have an uneven structure in the circumferential direction.

The linear pocket 1206 extends from the orifice 1202 in the axial direction. Particularly, the linear pockets 1206*a* and 1206*b* extend in parallel to each other toward one side in the axial direction. As illustrated in FIG. 19, each of the linear pockets 1206*a* and 1206*b* extends in the axial direction.

Here, the linear pocket of the rear bearing inflow passage extends in the axial direction. Thus, it is understood that the linear pockets 1206 extend to be close to each other in the axial direction. However, the linear pockets are disposed to be spaced apart from each other due to the same reason as the curve pockets 1204.

As a result, the linear pocket of the rear bearing inflow passage and the linear pocket of the front bearing inflow passage may extend to be close to each other in the axial direction and be spaced apart from each other in the axial direction. Thus, the inner circumferential surface of the cylinder 120, in which the linear pocket 1206 is provided, may have an uneven structure in the axial direction. Also, the first linear pocket 1206*a* and the second linear pocket 1206*b* extend in parallel to the circumferential direction.

The rear bearing inflow passage is the same the front bearing inflow passage except for the extension direction of the linear pocket. Thus, the description with respect to the rear bearing inflow passage will be omitted to cite the description with respect to the front bearing inflow passage.

Due to the above-described configuration, the pockets 1204 and 1206 may have a 'I' shape. Thus, the bearing refrigerant introduced into the orifice 1202 may flow along the pockets 1204 and 206 in the circumferential direction and the axial direction. That is, the bearing refrigerant may be filled into the pockets 1204 and 1206 that are recessed from the inner circumferential surface of the cylinder 120.

In this case, a bearing side passage 500 for causing the bearing refrigerant to flow in the circumferential direction is provided. Specifically, the bearing side passage 500 connects the bearing inflow passages 400 in the inner circumferential surface of the cylinder 120. In particular, the bearing side passage 500 is formed to extend from the second bearing inflow passage 1204 in the circumferential direction.

Accordingly, a part of the refrigerant received in the second bearing inflow passage 1204 flows through the bearing side passage 500 in the circumferential direction. That is, the bearing side passage 500 is formed to connect the curve pockets 1204*a* and 1204*b*, spaced apart from each other in the circumferential direction, to each other. Accordingly, refrigerant that has flowed into the first curve pocket 1204*a* and refrigerant that has flowed into the second curve pocket 1204*b* communicate with each other through the bearing side passage 500.

Figure 20:
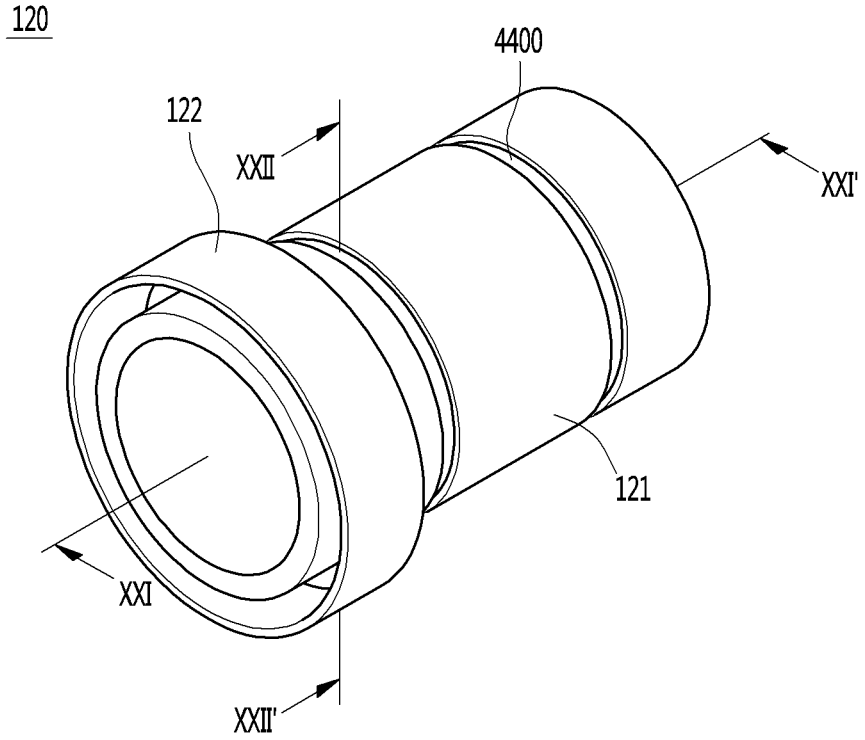
FIG. 20 is a view showing a cylinder of a linear compressor according to a fourth embodiment of the present invention.

FIG. 20 is a view showing a cylinder of a linear compressor according to a fourth embodiment of the present invention. In addition, FIG. 21 is a cross-sectional view taken along line XXI-XXI' of FIG. 20, and FIG. 22 is a cross-sectional view taken along line XXII-XXII' of FIG. 20.

Figure 21:
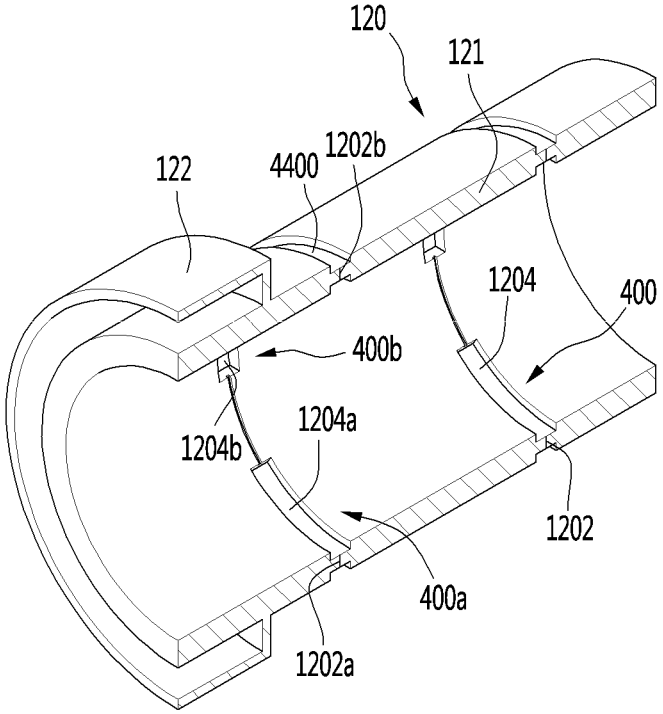
FIG. 21 is a cross-sectional view taken along line XXI-XXI' of FIG. 20.
Figure 22:
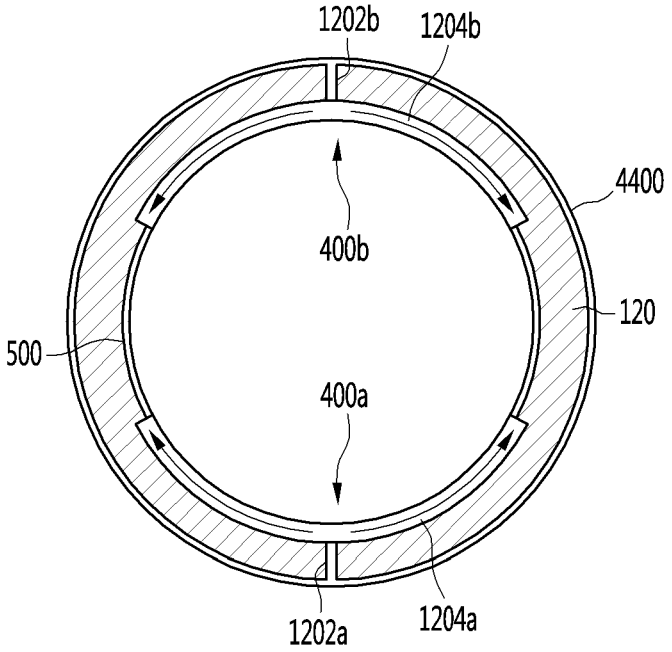
FIG. 22 is a cross-sectional view taken along line XXII-XXII' of FIG. 20.

As shown in FIGS. 20 to 22, a bearing inflow passage 400 of a linear compressor according to a fourth embodiment includes a filter installation groove 4400. The filter installation groove 4400 is formed to be recessed in the outer circumferential surface of the cylinder 120. In this case, the filter installation groove 4400 extends in the circumferential direction to have a ring shape.

The filter installation groove 4400 may be provided with a thread filter formed of a fiber or the like. For example, the thread filter may be installed to be wound around the filter installation groove 4400 in the circumferential direction on the outer circumferential surface of the cylinder 120.

In addition, the shape of the bearing inflow passage 400 except for the filter installation groove 4400 is the same as shown in FIGS. 15 and 16. Therefore, the description given with reference to FIGS. 15 and 16 will be referred to and the description will be omitted.

In this case, a bearing side passage 500 for causing the bearing refrigerant to flow in the circumferential direction is provided. Specifically, the bearing side passage 500 connects the bearing inflow passages 400 in the inner circumferential surface of the cylinder 120. In particular, the bearing side passage 500 is formed to extend from the second bearing inflow passage 1204 in the circumferential direction.

Accordingly, a part of the refrigerant received in the second bearing inflow passage 1204 flows through the bearing side passage 500 in the circumferential direction. That is, the bearing side passage 500 is formed to connect the pockets 1204*a* and 1204*b*, spaced apart from each other in the circumferential direction, to each other. Accordingly, refrigerant that has flowed into the first pocket 1204*a* and refrigerant that has flowed into the second pocket 1204*b* communicate with each other through the bearing side passage 500.

As shown in FIG. 15, the bearing side passage 500 connects second bearing inflow passages 1204 formed adjacent to the circumferential direction. In particular, the bearing side passage 500 is formed to be a groove extending in the circumferential direction. Referring to FIG. 16, the bearing side passage 500 is formed to be a ring-shaped groove as a whole.

That is, the filter installation groove 440 is formed in the outer circumferential surface of the cylinder 120, and the bearing side passage 500 is formed in the inner circumferential surface of the cylinder 120. In this case, the filter installation groove 440 and the bearing side passage 500 are provided in a ring shape forming a concentric circle in the radial direction with respect to each other.

As described above, the bearing inflow passage according to the present invention may be formed into various shapes in the cylinder. In addition, the bearing side passage is formed according to the shape of the bearing inflow passage, thereby more effectively supporting the piston.

The linear compressor including the above-described constituents according to the embodiment may have the following effects.

Since the piston is supported by using the relatively small amount of gas refrigerant, the consumed flow rate of the refrigerant required for the gas bearing may be reduced. Thus, the flow rate of the refrigerant in the whole system may increase to improve the compression efficiency.

Specifically, there is an advantage that the piston may be effectively supported through a bearing inflow passage for supplying refrigerant to the inner circumferential surface of the cylinder and a bearing side passage extending from the bearing inflow passage in the circumferential direction.

Particularly, the bearing side passage is formed into a ring shape extending in the circumferential direction, and the outer circumferential surface of the piston may be entirely supported along the circumferential direction. Further, there is an advantage that a sufficient amount of refrigerant for supporting the piston may be received through a bearing inflow passage formed to be recessed in the inner circumferential surface of the cylinder.

In addition, the relatively high pressure of the refrigerant received in the bearing inflow passages may be maintained through the plurality of bearing inflow passages provided in the same plane in the axial direction and spaced apart from each other in the circumferential direction. Thus, the supporting force for supporting the piston may increase.

The bearing side passage is formed to guide the flow of a small amount of refrigerant while maintaining the pressure inside the bearing inflow passage. Accordingly, a greater amount of refrigerant may support the piston.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor comprising:

a piston configured to reciprocate in an axial direction;

a cylinder that is disposed outside the piston in a radial direction and that surrounds an outer circumferential surface of the piston;

a frame that is disposed outside the cylinder in the radial direction and that surrounds an outer circumferential surface of the cylinder;

a first bearing gap defined between an inner circumferential surface of the frame and the outer circumferential surface of the cylinder;

a second bearing gap defined between an inner circumferential surface of the cylinder and the outer circumferential surface of the piston;

a bearing inflow passage defined in the cylinder and configured to guide fluid from the first bearing gap to the second bearing gap, the bearing inflow passage including a plurality of bearing inflow passages spaced apart from one another in a circumferential direction of the cylinder; and a bearing side passage that is recessed from the inner circumferential surface of the cylinder, that extends along the circumferential direction, and that is configured to guide, along the circumferential direction, the fluid introduced to the second bearing gap through the bearing inflow passage, wherein the bearing side passage includes an arc-shaped groove that extends along the circumferential direction and connects the plurality of bearing inflow passages to one another, and wherein a width of the bearing side passage in the axial direction is less than a width of one of the plurality of bearing inflow passages in the axial direction.

2. The linear compressor of claim 1, wherein the bearing inflow passage extends from a bearing inlet end defined at the outer circumferential surface of the cylinder to a bearing outlet end defined at the inner circumferential surface of the cylinder, and wherein the bearing side passage extends from the bearing outlet end along the inner circumferential surface of the cylinder in the circumferential direction.

3. The linear compressor of claim 2, wherein the plurality of bearing inflow passages have:

bearing inlet ends defined at the outer circumferential surface of the cylinder and spaced apart from one another in the circumferential direction; and bearing outlet ends defined at the inner circumferential surface of the cylinder and spaced apart from one another in the circumferential direction, and wherein each of the plurality of bearing inflow passages extends from one of the bearing inlet ends to the corresponding bearing outlet end among the bearing outlet ends.

4. The linear compressor of claim 3, wherein the bearing side passage connects the bearing outlet ends to one another and is configured to guide, along the circumferential direction, fluid received from the bearing outlet ends.

5. The linear compressor of claim 2, wherein the plurality of bearing inflow passages comprise:

a first bearing inflow passage that extends inward from the bearing inlet end in the radial direction; and a second bearing inflow passage that extends from the first bearing inflow passage to the bearing outlet end, and wherein a cross-sectional area of the first bearing inflow passage is less than a cross-sectional area of the second bearing inflow passage.

6. The linear compressor of claim 5, wherein the bearing side passage extends from the second bearing inflow passage along the circumferential direction, and wherein a cross-sectional area of the bearing side passage is less than the cross-sectional area of the second bearing inflow passage.

7. The linear compressor of claim 1, further comprising:

a suction pipe disposed rearward of the piston in the axial direction, wherein the cylinder and the piston define a compression space that is disposed inside the cylinder at a position forward of the piston in the axial direction and that is configured to receive refrigerant from the suction pipe, the piston being configured to compress refrigerant received in the compression space, and wherein the bearing side passage is disposed between the suction pipe and the compression space in the axial direction.

8. The linear compressor of claim 7, further comprising:

a discharge space that is defined at a position forward of the cylinder and the frame in the axial direction and that is configured to receive refrigerant discharged from the compression space; and a bearing supply passage that passes through the frame and that is configured to supply, to the first bearing gap, at least a part of refrigerant discharged into the discharge space.

9. The linear compressor of claim 1, further comprising a porous member disposed in the bearing inflow passage and configured to adjust an amount of refrigerant entering the bearing inflow passage.

10. The linear compressor of claim 1, further comprising a bearing filter disposed in the bearing inflow passage and configured to filter fluid from the first bearing gap, wherein the cylinder defines a stepped portion that is recessed from the outer circumferential surface of the cylinder toward the inner circumferential surface of the cylinder and that is configured to seat the bearing filter in the bearing inflow passage.

11. The linear compressor of claim 1, wherein the plurality of bearing inflow passages include:

a plurality of pockets recessed outward from the inner circumferential surface of the cylinder in the radial direction; and a plurality of orifices that extend outward from the plurality of pockets, respectively, to the outer circumferential surface of the cylinder in the radial direction.

12. The linear compressor of claim 11, wherein the plurality of pockets are arranged on a same plane orthogonal to the axial direction and are spaced apart from one another in the circumferential direction, and wherein the bearing side passage extends in the circumferential direction and connects the plurality of pockets to one another.

13. The linear compressor of claim 12, wherein the plurality of pockets comprises:

a curve pocket that extends along the circumferential direction from one of the plurality of orifices to both sides of the one of the plurality of orifices; and a linear pocket that extends along the axial direction from the one of the plurality of orifices to one side of the one of the plurality of orifices, and wherein the bearing side passage extends from the curve pocket along the circumferential direction.

14. The linear compressor of claim 1, wherein the bearing side passage is recessed outward in the radial direction relative to the second bearing gap and extends into the inner circumferential surface of the cylinder.

15. A linear compressor comprising:

a cylinder;

a piston disposed inside the cylinder and configured to reciprocate in an axial direction relative to the cylinder; and a frame that is disposed outside the cylinder in a radial direction and that surrounds an outer circumferential surface of the cylinder, wherein the frame and the cylinder define a first bearing gap between an inner circumferential surface of the frame and the outer circumferential surface of the cylinder, wherein the cylinder and the piston define a second bearing gap between an inner circumferential surface of the cylinder and an outer circumferential surface of the piston, wherein the cylinder defines a bearing inflow passage that passes through the cylinder from the outer circumferential surface of the cylinder to the inner circumferential surface of the cylinder, the bearing inflow passage being configured to supply fluid from the first bearing gap to the second bearing gap, and wherein the bearing inflow passage comprises:

a plurality of pockets recessed outward from the inner circumferential surface of the cylinder in the radial direction, and a plurality of orifices that are recessed outward from the plurality of pockets, respectively, to the outer circumferential surface of the cylinder in the radial direction, wherein each of the plurality of pockets includes a first arc-shaped groove that extends from one of the plurality of orifices along a circumferential direction of the cylinder, and wherein the cylinder further defines a bearing side passage that is recessed outward from the inner circumferential surface of the cylinder, the bearing side passage including a second arc-shaped groove that extends in the circumferential direction and connects the plurality of pockets to one another.

16. The linear compressor of claim 15, wherein a recess depth of each of the plurality of pockets from the inner circumferential surface of the cylinder in the radial direction is greater than a recess depth of the bearing side passage from the inner circumferential surface of the cylinder in the radial direction.

17. The linear compressor of claim 16, wherein the recess depth of each of the plurality of pockets from the inner circumferential surface of the cylinder varies along the circumferential direction.

18. The linear compressor of claim 15, wherein the bearing side passage is recessed outward in the radial direction relative to the second bearing gap and extends into the inner circumferential surface of the cylinder.

19. The linear compressor of claim 15, wherein a width of the first arc-shaped groove in the axial direction is greater than a width of the second arc-shaped groove in the axial direction.

20. The linear compressor of claim 15, wherein a width of the first arc-shaped groove in the axial direction is different from a width of the second arc-shaped groove in the axial direction.

* * * * *